US011284185B2

(12) United States Patent
Lewis

(10) Patent No.: US 11,284,185 B2
(45) **Date of Patent: *Mar. 22, 2022**

(54) PROTECTIVE HEADPHONE COVER

(71) Applicant: JLBF Enterprises, Los Angeles, CA (US)

(72) Inventor: Joshua Aaron Lewis, Los Angeles, CA (US)

(73) Assignee: JLBF Enterprises, Los Angeles, CA (US)

( * ) Notice: Subject to any disclaimer, the term of this patent is extended or adjusted under 35 U.S.C. 154(b) by 148 days.

This patent is subject to a terminal disclaimer.

(21) Appl. No.: 16/554,599

(22) Filed: Aug. 28, 2019

(65) Prior Publication Data

US 2019/0387308 A1 Dec. 19, 2019

Related U.S. Application Data

(63) Continuation-in-part of application No. 15/844,348, filed on Dec. 15, 2017, now Pat. No. 10,448,145.

(60) Provisional application No. 62/434,945, filed on Dec. 15, 2016.

(51) Int. Cl.
*H04R 1/10* (2006.01)

(52) U.S. Cl.
CPC ..... *H04R 1/1091* (2013.01); *H04R 1/1008* (2013.01); *H04R 1/1058* (2013.01)

(58) Field of Classification Search
CPC ..... H04R 1/12; H04R 1/1091; H04R 1/1008
See application file for complete search history.

(56) References Cited

U.S. PATENT DOCUMENTS 3,645,354 A * 2/1972 Kliewer ..... H04R 1/1008 181/129
5,269,314 A * 12/1993 Kendall ..... A61B 7/02 181/131
5,545,859 A * 8/1996 Ullrich ..... H04R 1/12 181/129
6,980,666 B1 * 12/2005 Owen ..... H04R 5/033 381/371
10,075,786 B2 * 9/2018 Larsen ..... H04R 1/023
2002/0146115 A1 * 10/2002 Zohn ..... H04R 1/12 379/451
2004/0099666 A1 * 5/2004 Ordiway ..... B65D 41/22 220/287

(Continued)

FOREIGN PATENT DOCUMENTS

KR 101501942 B1 * 3/2015

*Primary Examiner* — Joshua T Kennedy

(57) ABSTRACT

A protective headphone cover comprising a cover member configured to interface with an outer side of a headphone, and an elastic locking member attached to the cover member and defining an elastic opening operable to wrap around the headphone. The protective headphone cover can also comprise at least one inner panel pivotally attached to the cover member and interfaceable to an inner side of the headphone. The at least one inner panel can comprise an audio opening to facilitate passage of audio waves from the headphone to the user. The at least one inner panel can comprise a first inner panel and a second inner panel attached to each other about an intermediate joint attachment section. A method of making a protective headphone cover, and a method of protecting headphones, are provided.

25 Claims, 12 Drawing Sheets

(56) References Cited

U.S. PATENT DOCUMENTS

| | | | | |
|---|---|---|---|---|
| 2008/0187151 | A1* | 8/2008 | McClenon | H04R 1/12<br>381/74 |
| 2016/0337738 | A1* | 11/2016 | Hayashi | H04R 1/10 |
| 2017/0118552 | A1 | 4/2017 | White | |

* cited by examiner

PROTECTIVE HEADPHONE COVER

RELATED APPLICATIONS

This application is a continuation in-part application, which claims the benefit of U.S. patent application Ser. No. 15/844,348, filed Dec. 15, 2017, which claims the benefit of U.S. Provisional Application Ser. No. 62/434,945, filed Dec. 15, 2016, each of which is incorporated herein by reference in their entirety.

BACKGROUND

Consumer headphones are increasingly becoming more expensive because of improved technology and materials. For example, some headphones have quite large, comfortable headphones or earpieces made of memory foam, sponge, leather, vinyl, composites, etc. that surround and protect expensive audio speaker and other components, and that provide comfort for the wearer. Many headphones are designed to block noises from the surrounding area so that the user can experience better or enhanced sound quality. In some cases, the earpiece cover of the headphone naturally adheres to the skin when it covers the ears. However, foreign materials such as dirt, dust, bacteria, oils, grease, moisture, sweat, and other undesirable materials can collect on and around the earpieces of the headphones, which can cause degradation of the headphones, and in some cases this can cause the headphones to become unsanitary. The presence of foreign materials often reduces the life of the headphones because the earpieces become uncomfortable or worn out (even though the expensive audio speakers may still work fine). For example, over time, abrasions may appear on the surfaces of earpieces of the headphones, such as a result of the user cleaning them or storing the headphones. In other cases, cleaning the headphones with a cleaner may naturally deteriorate the material of the headphone cover. As the materials of the earpieces of the headphones begin to wear and breakdown, for example as the soft materials making up the earpieces wears, parts of the material can fragment and gradually peel off, or small holes can begin to form on or in the material. In such cases, secretions from human skin can infiltrate the materials, which provides a breeding ground for various bacteria.

For these reasons, contaminated headphone earpiece materials should be changed, but it is difficult for users to change such materials because they are usually formed integral with the earpieces of the headphones. Unfortunately, headphones are often discarded when the earpiece material wears out or breaks down, even when the headphone electronics are still functioning.

SUMMARY

The present disclosure sets forth a protective headphone cover, comprising a cover member adapted to interface with an outer side surface of a headphone; an elastic strip panel adhered to an inner surface and an outer surface of the cover member, thereby covering and wrapping around a first edge of the cover member; and at least one inner panel attached to the cover member, and configured to interface with an inner side surface of the headphone. The elastic locking member can comprise an elastic strip panel wrapped around the first edge of the cover member, and bonded or otherwise adhered to the cover member, thus eliminating the need to stitch the elastic locking member to the cover member.

The elastic strip panel can be folded over the first edge of the cover member and conceals the first edge.

The cover member can comprise an interface surface and an outer surface, the first edge of the cover member being defined between the interface surface and the outer surface, wherein a first inner surface portion of the elastic locking member can be attached to the interface surface of the cover member, and a second inner surface portion of the elastic locking member can be attached to the outer surface of the cover member, such that the first edge of the cover member is concealed by the elastic locking member.

The elastic locking member can comprise a rectangular panel shape prior to being joined to the cover member.

The elastic locking member can comprise a first elastic edge, an opposing second elastic edge, and a middle elastic portion situated between the first and second elastic edges, wherein the middle elastic portion can receive and cover the first edge of the protective headphone cover.

The first elastic edge can extend circumferentially about an interface surface of the cover member, and the second elastic edge can extend circumferentially about an outer surface of the cover member.

The elastic locking member can comprise a first end attachment section and a second end attachment section joined together. The first end attachment section and the second end attachment section can be overlapped on each other and adhered together via an adhesive.

The elastic locking member can be adhered or bonded (the adhesive can be heat activated or heat and pressure activated, and the elastic member subsequently adhered or bonded) to the first edge of the cover member using an adhesive. Likewise, ends of the elastic locking member can be heat adhered together using an adhesive.

The elastic locking member can comprise single-sided adhesive tape.

The elastic locking member can comprise an inner attachment surface and an outer exposed surface, wherein the inner attachment surface can comprise an adhesive film layer disposed along the entire inner attachment surface, so as to facilitate bonding of the inner attachment surface to the cover member.

The adhesive film layer can be heat activated, such that application of at least one of heat or pressure to the elastic locking member and the cover member activates the adhesive film layer to adhere or bond the elastic locking member to the first edge of the cover member.

The at least one inner panel can be comprised of a fabric material configured to cover at least of portion of a cushion of the headphone.

The cover member and the at least one inner panel can each comprise an elastic fabric material.

The at least one inner panel can comprise a first inner panel and a second inner panel operable to form a dual-panel assembly, each of the first and second inner panels having an audio opening and a perimeter edge, the perimeter edges of each of the first and second inner panel being coupled to each other and attached to the second edge of the cover member.

The protective headphone cover can further comprise an edge joining member securing together third and fourth edges of the cover member, the edge joining member comprising an adhesive layer.

The present disclosure also sets forth a protective headphone cover comprising a cover member adapted to interface with an outer side surface of a headphone, the cover member comprising a first edge and an opposing second edge; an elastic locking member adhered or bonded to the first edge of the cover member and supported about an elastic expanding opening in the cover member, the elastic locking member being adapted to wrap around the outer side surface of the headphone and to secure the protective headphone cover in place about the headphone; and at least one inner panel having a perimeter edge attached to the second edge of the cover member, and configured to interface with an inner side surface of the headphone.

The present disclosure further sets forth a method of making a protective headphone cover comprising forming a cover member having a first edge and a second edge; attaching an elastic locking member to the first edge of the cover member to form an elastic opening that is expandable around a headphone; forming at least one inner panel having a perimeter edge; and attaching the perimeter edge of the at least one inner panel to the second edge of the cover member.

DETAILED DESCRIPTION

Reference will now be made to certain examples and specific language will be used herein to describe the same. It will nevertheless be understood that no limitation of the scope of the invention is thereby intended. Alterations and further modifications of the inventive features illustrated herein, and additional applications of the principles of the disclosure as illustrated herein, which would occur to one skilled in the relevant art and having possession of this disclosure, are to be considered within the present scope. It is also to be understood that this invention is not limited to the particular configurations, process actions and materials disclosed herein as these may vary to some degree. Further, it is to be understood that the terminology used herein is used for the purpose of describing particular examples only, which terminology is not intended to be limiting as to the scope of the claims.

Figure 1:
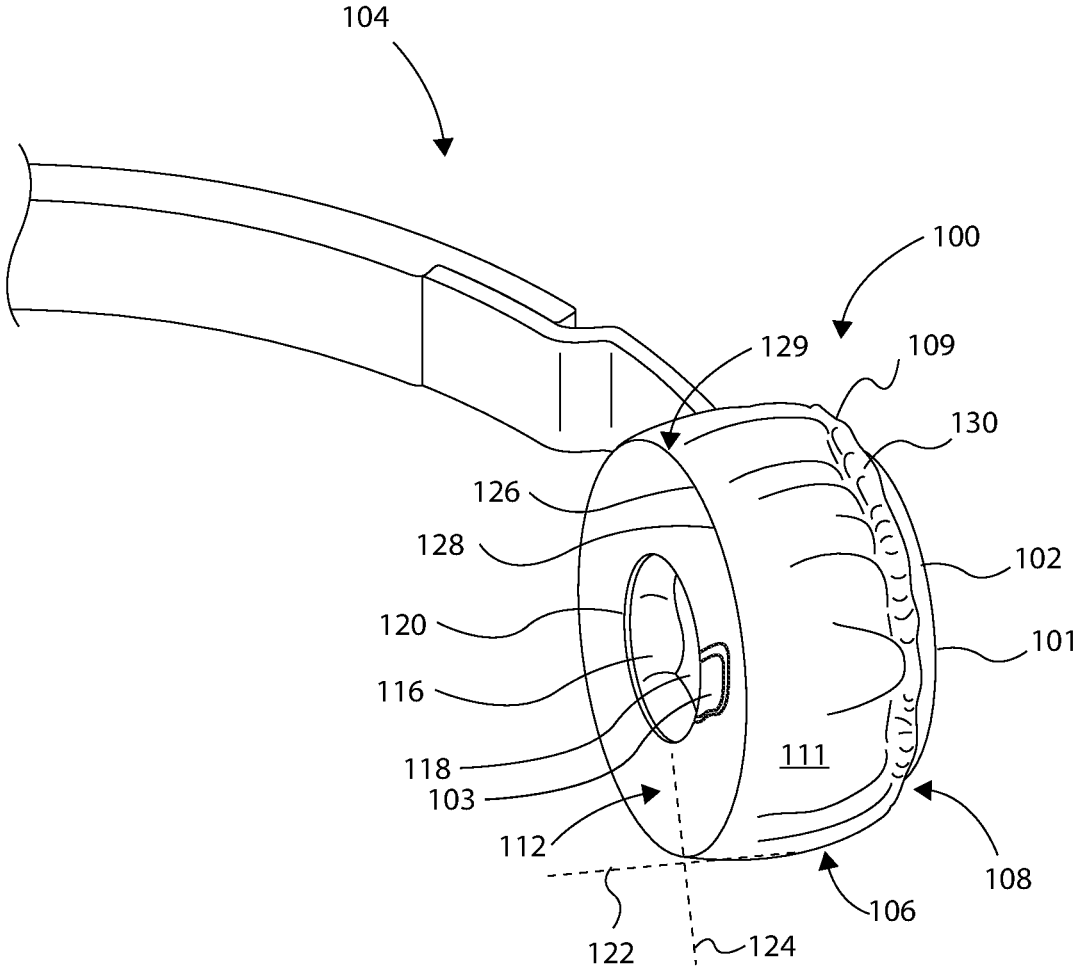
FIG. 1 is a partial isometric view of a headphone having a protective headphone cover wrapped around or covering at least a portion of an earpiece of the headphone, in accordance with an example of the present disclosure.
Figure 2:
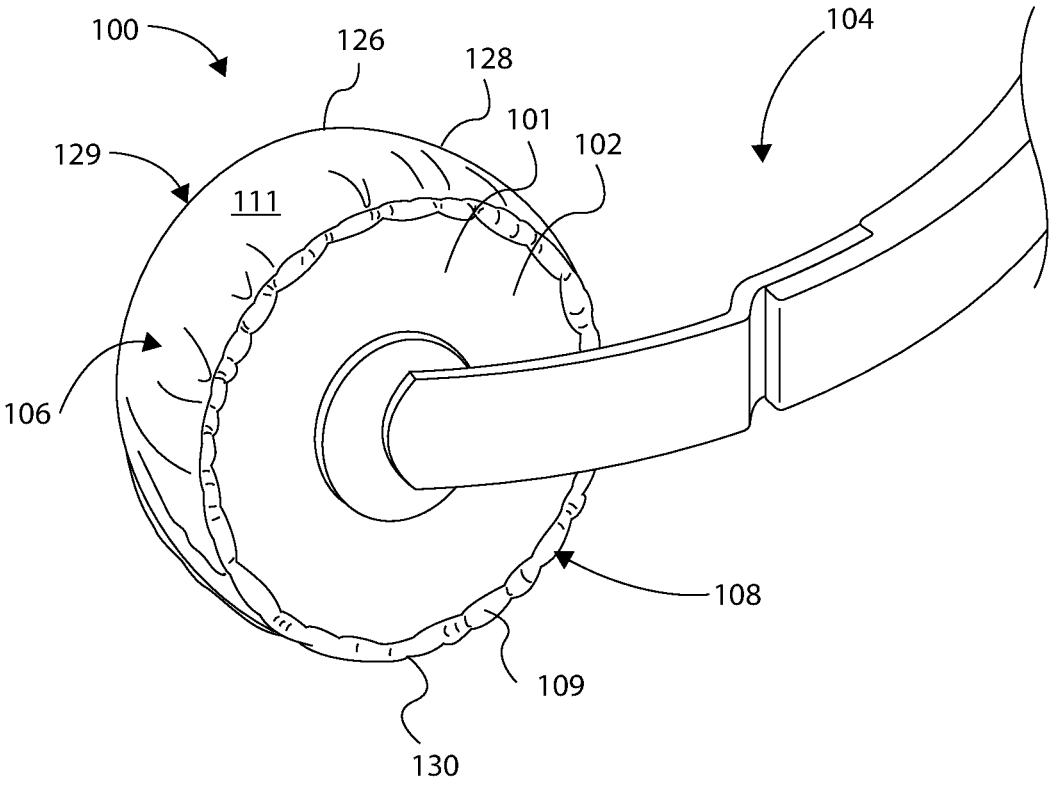
FIG. 2 is a partial isometric view of the example headphone and protective headphone cover of FIG. 1.
Figure 3:
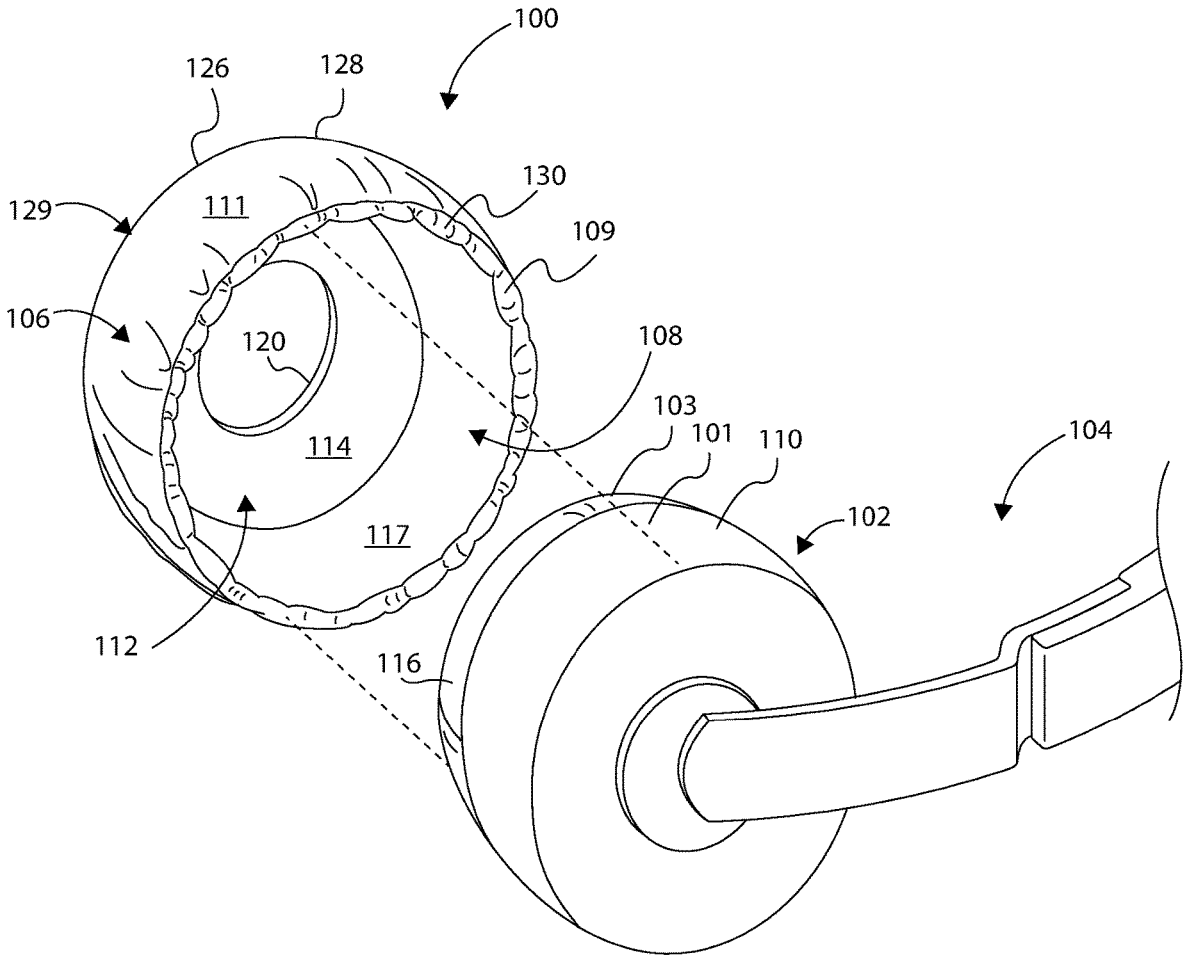
FIG. 3 is a partial isometric view of the example headphone and protective headphone cover of FIG. 1, showing the protective headphone cover exploded from the earpiece of the headphone.

FIGS. 1 and 2 show respective inner and outer isometric views of a protective headphone cover 100 covering the earpieces of an example type of headphone 102, these forming a headphone assembly 104 in accordance with an example of the present disclosure. The headphone assembly 104 can comprise left and right headphones (e.g., FIG. 10), although FIG. 1 only shows one of such headphone 102 for illustration clarity. FIG. 3 illustrates the headphone assembly 104, with the protective headphone cover 100 exploded or removed from earpieces of the headphone 102 (and shown in an expanded state). At the outset, it is noted herein that the earpieces of the headphones discussed herein with reference to the various examples serve to describe those portions of the headphone that are designed to interface with and to be placed next to the head and ears of the user (e.g., positioned on the ear or around or over the ear), and to deliver sound to the user's ears. Those skilled in the art will recognize that headphones come in a variety of different sizes, shapes and configurations, and that the example headphones and corresponding headphone covers disclosed and discussed herein are not meant to be limiting. Indeed, the headphone covers can be sized, shaped and configured to correspond to and to work with any type of headphones.

With reference to FIGS. 1-3, the protective headphone cover 100 can comprise a cover member 106 having an expanding opening 108 configured to receive an earpiece 101 of the headphone 102, wherein the cover member 106 is configured to wrap around and interface with at least a portion of an outer side surface 110 of the earpiece 101 of the headphone 102 (see FIG. 3). In some examples, the cover member 106 can be referred to as a "fabric cover member" or an "outer side portion" of the headphone cover 100. The expanding opening 108 can be defined by an elastic locking member 109 coupled to an attachment edge (e.g., 130) of the cover member 106, such that the expanding opening 108 is expandable around the earpiece 101 of the headphone 102 to removably attach or couple the protective headphone cover 100 to the earpiece 101 of the headphone 102 as shown in FIGS. 1 and 2, with the elastic locking member 109 functioning to secure the protective headphone cover 100 to the headphone by contracting around the headphone, thereby applying a radially inward force about the contacted surface of the headphone. As further discussed below, the protective headphone cover 100 can be flexible so as to be able to accommodate various sized, shaped and configured headphones.

The cover member 106 can comprise a headphone interface surface 117 defining an innermost or interior surface of the cover member 106 of the protective headphone cover 100. The interface surface 117 can be adapted to interface with or bias against at least a portion of an outer surface of the outer side 110 of the headphone 102, as well as an outer surface of the original headphone cover 116 as the protective headphone cover 100 is placed over and conforms to the earpiece 101 of the headphone 102. The cover member 106 can further comprise an outer surface 111 that generally defines an outer perimeter of the protective headphone cover 100. The interface surface 117 and the outer surface 111 can be adapted to be placed onto, and to extend around and provide a cover about, the original headphone cover 116 or the outer side 110 or both of the earpiece 101 of the headphone 102. The outer surface 111 can be one of the surfaces of the protective headphone cover 100 exposed to the environment to provide an initial barrier of protection that functions to protect the headphone 102.

The protective headphone cover 100 can further comprise at least one inner panel 112 (forming an inner cover member or inner side portion (in some examples also being referred to as an inner fabric panel)) attached to the cover member 106, wherein, in one example, the headphone cover 100 can comprise distinct, different component parts, namely the elastic locking member 109, the inner panel 112 (e.g., being comprised of a panel of fabric or other flexible material, as discussed below), and the cover member 106 (e.g., being comprised of a panel of fabric or other flexible material, as discussed below). In another example, however, the inner panel 112 can be integrally formed with the cover member 106 (e.g., formed from the same piece of material). Indeed, in this example, the inner panel 112 and the cover member 106 can be formed from one unitary piece of material, such as fabric, for instance.

The inner panel 112 can comprise a first headphone interface surface 114 configured to interface with or bias against, and to be positioned adjacent and juxtaposed, at least a portion of an original headphone cover 116 of the earpiece 101 of the headphone 102, and particularly to interface with and be juxtaposed a user contact surface 103 (or an "inner side surface") of the original headphone cover 116 (see FIG. 1, showing the user contact surface 103 of the original headphone cover 116 being hidden or covered by the inner headphone side portion 112). The original headphone cover 116 can form a part of the earpiece, namely it can comprise the outer material that covers the soft, cushion component of the earpiece, the user contact surface being adapted to directly come in contact with the user's head or ear or both during use of the headphones (i.e., without the protective headphone cover 100). The user contact surface of the original headphone cover 116 can be described as that particular surface or portion of the original headphone cover 116 intended to actually directly interface with the head or ear or both of the user. In the example shown, the inner panel 112 of the protective headphone cover 100 can be formed as a generally flat or planar panel (e.g., see FIG. 3 with the protective headphone cover 100 removed from the earpiece of the headphone 102). In use, with the protective headphone cover 100 placed over the earpiece of the headphone 102, the inner panel 112 can be disposed or positioned between the user contact surface of the original headphone cover 116 and the head or ear or both of the user. Of course, those skilled in the art will recognize that application of the same protective headphone cover 100 to headphones of different size, shape or configuration, can cause the inner panel 112 to conform differently, in some cases deviating to a degree from its initial or relaxed planar state. For instance, when the protective headphone cover 100 is positioned over an earpiece of a headphone, the protective headphone cover 100 will conform to the shape of the earpiece, such that the inner panel 112 conforms to the earpiece, and particularly the user contact surface of the earpiece. Depending upon the shape and contour of the user contact surface, the inner panel 112 can be adapted to match and conform to the given contour (e.g., the inner panel can extend along a curve or curved plane, a curvilinear plane, or a combination of these that matches the that of the user contact surface earpiece of the headphones).

The inner panel 112 can have an opening or an audio opening 120 sized and shaped to facilitate passage of audio waves from the audio speaker 118 of the headphone 102 to a user's ear. In one example, the opening can comprise a void, such that there is no physical part of the protective headphone cover 100 within the boundary of the opening. Rather, an inside edge of the inner panel 112 defines and circumscribes the opening 120, such that are no components or elements or features of the protective headphone cover 100 that extend inwardly into the defined void that would otherwise be situated between the audio speaker 118 and the user's ear when wearing the headphone 102 supporting the protective headphone cover 100. In this example, the opening 120 facilitates unobstructed passage of audio waves through the opening 120 (i.e., the audio waves pass through the opening without coming into contact with or having to pass through material making up the protective headphone cover 100, even though some audio waves not directed through the opening 120 can pass through the protective headphone cover 100). In other examples, the protective headphone cover 100 can comprise an acoustically transparent or semi-transparent screen or panel disposed and supported within the opening 120. In one aspect of this example, an inside edge of the inner panel 112 can still define and circumscribe the opening 120, with the acoustically transparent or semi-transparent screen supported about the inner panel 112 to essentially extend into and cover the opening 120. In still other examples, the inner panel 112 can be formed without an opening, such that the user contact surface of the original cover 116 of the headphone 102 is completely covered by the inner panel 112. The inner panel 112 can be comprised of an acoustically transparent or semi-transparent material, which material can be the same as or different from the cover member 106. In the cases where an acoustically transparent or semi-transparent material is utilized, the protective capabilities of the protective headphone cover 100 will be enhanced over the opening having the void as the acoustically transparent or semi-transparent screen can provide an additional protective barrier not present with the void example. The audio opening 120 can be a circular or any other shaped opening. Moreover, the opening 120 can be sized and configured to provide little to no impact on the quality of audio generated by the headphone 102. For example, the opening 120 can be sized and configured so that it maximizes sound transmission from the headphone 102 to the user, and does not inhibit or distort audio waves generated from the audio speaker 118. In some examples, the opening 120 can comprise an area that is between 1-2 inches square. These examples are not meant to be limiting, as the audio opening can be suitably sized and shaped to allow passage of audio waves therethrough without distorting or damping (in those cases where the opening 120 comprises a void (or without noticeably distorting or damping, in those cases where an acoustically transparent screen is utilized)) the audio signal, and without deterring from the principal purpose of the audio opening.

Due to its construction and arrangement of components, the protective headphone cover 100 can conform to the earpiece 101 of the headphone 102. Thus, In some examples, such as where the earpiece 101 of the headphone 102 is generally cylindrically shaped, the protective headphone cover 100 can conform to the various components making up the generally cylindrically shaped earpiece. In one example, the cover member 106 can comprise an rectangular shaped panel or panel member connected end to end to form a cylindrical body, and that is adapted to cover at least a part of the earpiece of the headphone (e.g., the cover member 106 is configured to cover and interface with at least a portion of an outer side 110 or the original cover 116 of the earpiece, or both), as shown in FIGS. 1 and 2, and therefore is capable of being generally cylindrically shaped (the shape of the cover member 106 can change, depending on the shape of the earpiece of the headphone 102 or during expansion to/from a relaxed state and a fully expanded state of the protective headphone cover 100). In this example, FIG. 1 illustrates the protective headphone cover 100 in a substantially fully expanded state and as applied to an earpiece of the headphone 102. In this position, a first plane 122 extends about the cover member 106 in a tangential manner intersecting about a line extending from edge to edge of the cover member 106, as illustrated by the dashed lines. Because the inner panel 112 is intended to interface with the user contact surface of the original headphone cover 116 in a planar or substantially planar manner, the inner panel 112 can extend along and define a second plane 124, as illustrated by the dashed line, when the protective headphone cover 100 is properly situated and in place about the earpiece of the headphone 102. Here, the first plane 122 can be generally or substantially orthogonal or perpendicular to the second plane 124. In other examples, depending on the particular shape of the headphone 102, the first plane 122 can be configured to extend at another angle relative to the second plane 124, such as one where the protective headphone cover 100 defines a frustoconical shape, a clam-shell shape (e.g. FIG. 9), or other resulting shape as defined by the headphone cover conforming to or wrapping around the particular shape of the earpiece of the headphones.

The inner panel 112 can comprise a generally planar configuration when the protective headphone cover 100 is fully expanded, and even when it is placed about and interfaced with the user contact surface of the original cover 116 of the earpiece of the headphone 102, such that this generally planar configuration is independent of the configuration or orientation of the elastic locking member when secured about the headphone 102. That is, despite the positions or orientations of the expanding opening 108 and the cover member 106 as the protective headphone cover 100 is being expanded from a relaxed state to a fully expanded state, or when it is being positioned onto the earpiece of the headphone 102, the inner panel 112 maintains its planar configuration and orientation ultimately being positioned adjacent to and juxtaposed the planar user contact surface of the original headphone cover 116 (see also FIG. 9 that illustrates this principle). This is discussed in more detail below.

Said another way, the user contact surface about the second plane 124 can extend and be oriented so as to be substantially parallel to a sagittal plane (i.e., mid-sagittal or parasagittal plane) of the user, and therefore, the inner panel 112 itself can extend and be oriented so as to be substantially parallel to the sagittal plane of the user. In addition, the cover member 106 can extend about the first plane 122 that is substantially orthogonal or perpendicular to the second plane 124 and the sagittal plane of the user, wherein the cover member 106 extends about the plane 122, which is shown as being parallel to the frontal or coronal plane of the user when worn. Of course, the first plane 122 can be located at any tangential position around the circumference of the cover member 106 intersecting any line extending perpendicularly from one edge of the cover member 106 to the opposite edge to illustrate the planar orientation of the cover member 106 relative to the inner panel 112, and as such, will not always necessarily be parallel with the coronal plane of the user even though this is how it is shown in FIG. 1.

Maintaining the shape and position of the original headphone cover 116 is desirable for comfort of the user, and for purposes of maintaining the original shape and design of the headphones for audio integrity purposes. That is, if the original headphone cover 116 is smashed or distorted due to an attached headphone cover, outside audio signals may enter the user's ear, and some audio signals from the headphone 102 may escape. This could defeat the purpose of having a relatively large, comfortably fitting original headphone cover. Many available headphones have an original headphone cover that is comprised of a vinyl or leather cover over a cushioning ring or member surrounding the audio speaker, for instance. Such cushions are typically quite soft for comfort of the user and are made of material capable of attenuating sound for maximizing audio insulation between the user and the outside environment. Thus, such soft cushions can readily fully compress or be distorted with small amounts of force, such as less than half a pound in some examples. The amount of compliance of the cushion is typically dependent on the size of the user's head, as well as the amount of clamping force against the user that is exerted by the arced headphone coupling member that extends over the top of the user's head to couple left and right headphone earpieces to the user. If such cushioning members are too hard, or are otherwise compressed too much, the user is likely to experience undesirable discomfort around the ears, which necessarily limits the time a user would want to wear the headphones. As mentioned above, this can also affect the sound quality, and thus the experience of the user with the headphones.

Accordingly, the present protective headphone cover 100 (and others exemplified herein) is designed in a particular manner and configuration to avoid or prevent such undesirable compression or distortion of the original headphone cover 116 and the cushion rings or cushion member being covered by this. In other words, the protective headphone covers disclosed herein are intended to minimally impact or disrupt the use of the headphones by not distorting any of the original components of the headphones. This is because the inner panel 112 is designed and shaped to remain generally planar against the original headphone cover 116, as discussed above, while the expanding opening 108 and the cover member 106 apply a sufficient force to maintain the headphone cover 100 in a specific position on the headphone 102. In this manner, the inner panel 112 is not "pulled too tightly" against or around the original headphone cover 116 such as to compress or distort the original headphone cover 116 or the cushioning member it is protecting. Rather, the inner panel 112 and the cover member 106 are configured to somewhat float about the original headphone cover 116 with any forces being exerted by the inner panel 112 being insufficient to compress or distort the cushioning member inside the original headphone cover 116, and the majority of securing forces being applied to the earpiece of the headphone 102 by the cover member 106 and the expanding opening 108. This results in a more natural or intended fit of the headphone 102 against or around the user's ear, so that the headphone cover 100 can merely act as a sanitary cover or buffer (as opposed to a constricting device that deforms the original headphone cover 116 to an uncomfortable position or orientation to the user).

In some examples, the inner panel 112 can comprise the same type of fabric or material as the cover member 106, while in other examples the inner panel 112 can comprise a fabric component or material different from the cover member 106. Moreover, the inner panel 112 can be formed of a flat or planar fabric panel that may have a generally curved profile (e.g., circular, oval, curvlinear, etc.) that may be attached at a perimeter edge 126 to a first edge 128 of the cover member 106 to form an intermediate attachment joint section 129. The intermediate attachment joint section 129 can be the area or portion at which the inner panel 112 is attached to or otherwise intersects the cover member 109. In one aspect, the inner panel 112 can comprise two separate components joined together. In another example, the cover member 106 can be integrally formed with the inner panel 112 using the same piece of fabric. In either scenario, the intermediate attachment joint section 129 can be the area or portion of transition from the generally planar surface of the inner panel 112 positioned in a plane oriented in one direction, to the generally planar surface or shape of the cover member 106 extending about a plane oriented in another direction (e.g., orthogonal with the protective headphone cover 100 in a fully expanded state). The intermediate attachment joint section 129 and the defined transition area or portion is designed and configured to facilitate maintaining the planar orientation of the inner panel 112 independent of the orientation of the cover member 109 when coupled to the headphone 102. An example of this structure and its advantages will be further exemplified below regarding FIGS. 6A-7B.

In one example, the cover member 106 can be formed from a generally rectangular shaped fabric profile (e.g., see FIG. 4) having a second edge 130 opposite the first edge 128, and that supports or couples the elastic locking member 109 to the cover member 106. The elastic locking member 109 can comprise an unexpanded length that is less than a length of the first edge of the cover member 106, wherein the elastic locking member 109 can be expanded to match a length of the first edge of the cover member 106, and then joined along the full length of the first edge of the cover member 106. Thus, the first edge can comprise a bunched, drawn-in configuration upon the elastic locking member 109 being contracted and in a relaxed state. Thus, the elastic locking member 109 may draw in and bunch or bundle the second edge 130, wherein the expanding opening 108 is narrowed. Moreover, the elastic locking member 109 facilitates the protective headphone cover 100 being movable from a contracted state (e.g., see FIGS. 5 and 6) to an expanded state (e.g., see FIGS. 1-3), and back to the contracted state, by a user opening or expanding the expanding opening 108 of the headphone cover 100, such as would be the case as the protective headphone cover 100 is being installed onto and around the earpiece of the headphone 102.

The cover member 106, the inner panel 112, and the elastic locking member 109 can be attached to each other by various means, such as via sewn threads, adhesive applications, or other suitable applications of attachment known by those skilled in the art. The cover member 106 and the inner panel 112 can be formed of a variety of fabrics or materials both natural and/or synthetic, such as spandex material, nylon, natural fabrics, woven fabrics, polyester, synthetic fabrics, blended fabrics, Gore-Tex, etc., or a combination thereof. Some or all of these materials can be absorbent and/or breathable to minimize the amount of heat generated and any resulting sweat or moisture having the potential to pass through the headphone cover 100 to the headphone 102. The elastic locking member 109 can be comprised of an elastic material, such as synthetic fiber(s) or material(s), or natural material(s). In one example, the elastic locking member 109 can comprise an elastic band having a flexible outer material that facilitates coupling or attachment (e.g., sewing) of the elastic locking member 109 to the cover member 106. In some examples where the cover member 106 is comprised of an elastic or stretchable material, the second edge 130 may merely be sewn tightly or otherwise bunched tightly together to generate an expanding opening, thereby obviating the need for a separately coupled elastic locking member (indeed, the edge itself functions as the locking member). In other examples, an elastic strap may be coupled to one portion of the second edge 130 of the cover member 106, and then elastically extended over an outer side area of the headphone, and then removably coupled to another portion of the second edge 130 (similar to elastic straps for snow chains on a tire of a vehicle).

Figure 4:
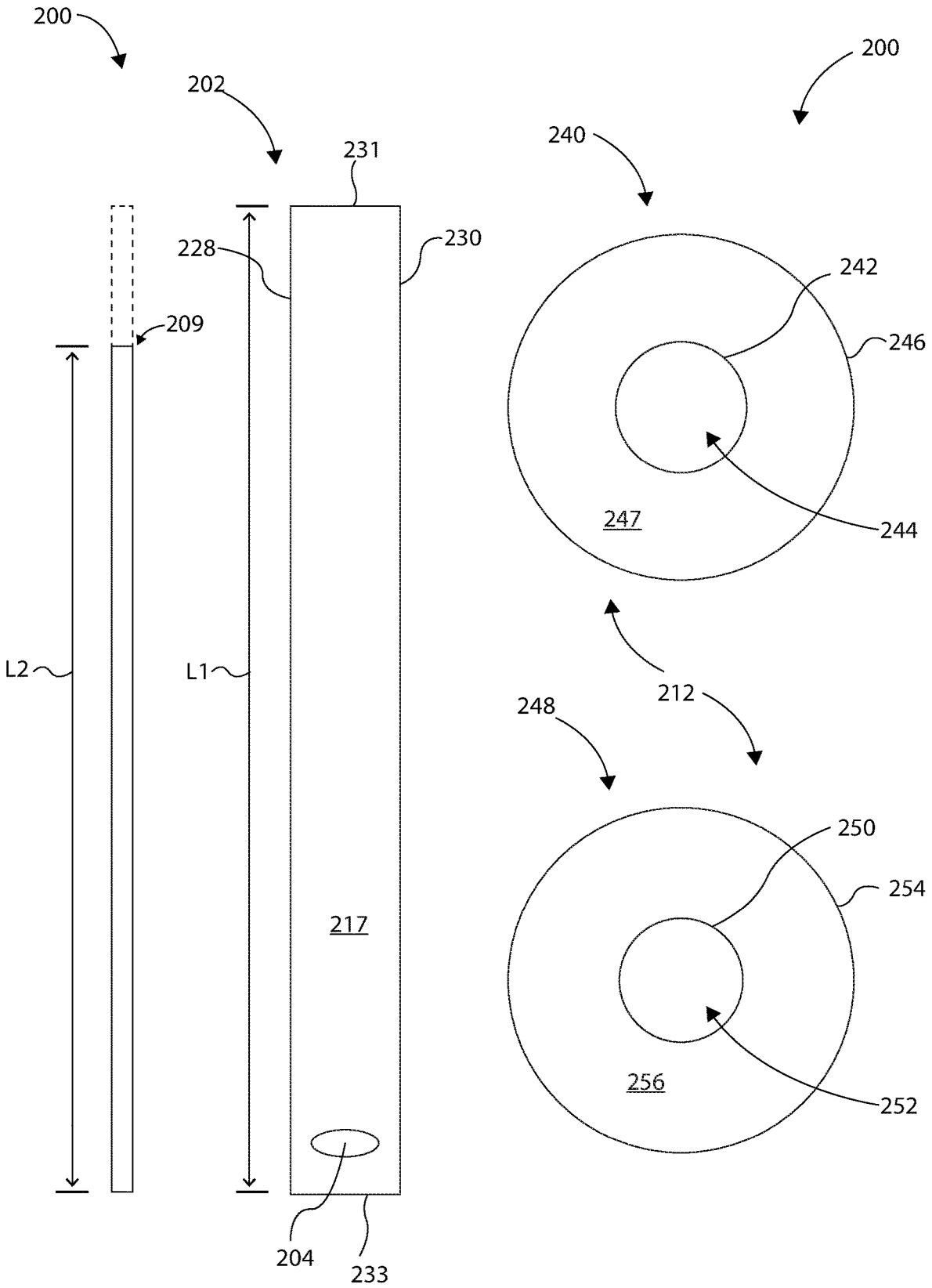
FIG. 4 is a plan view of the individual components of a protective headphone cover in accordance with an example of the present disclosure.
Figure 5A:
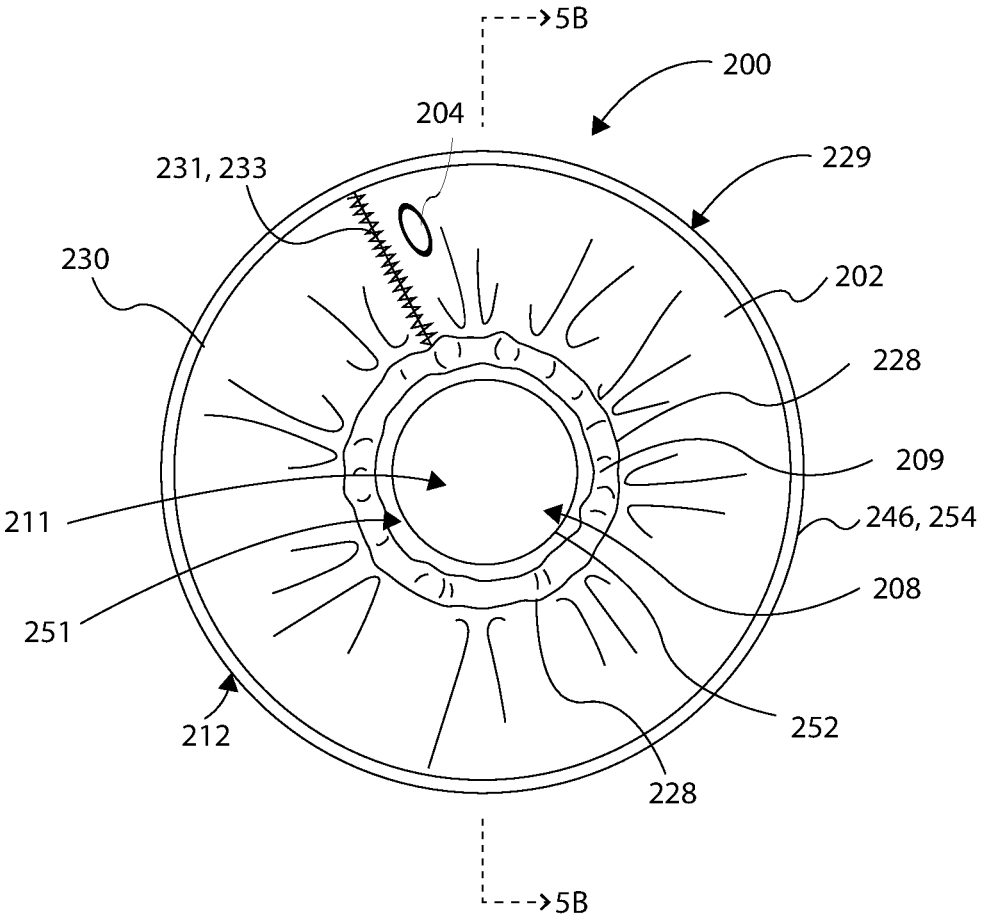
FIG. 5A is a top view of the protective headphone cover of FIG. 4 shown with the components assembled, and shown as removed from a headphone and in a relaxed, contracted state.

FIGS. 4-7B illustrate various aspects of a protective headphone cover 200 in accordance with an example of the present disclosure. The protective headphone cover 200 can be the same or similar as the protective headphone cover 100 of FIGS. 1-3, as will be appreciated from the below discussion. As such, the discussion provided above is incorporated here, as appropriate, and as will be recognized by those skilled in the art. In this example, FIG. 4 shows a plan/part view of various components that can make-up or form the protective headphone cover 200, as detailed below. And, FIGS. 5A-6C show views of the assembled protective headphone cover 200, as referenced below.

In this example, the protective headphone cover 200 can comprise a cover member 202 (an outer cover member or an outer side portion), as illustrated in FIG. 4 as being unattached, and in FIGS. 5A-7B as being attached to other components of the protective headphone cover 200. The cover member 202 can be the same or similar as the cover member 106 of FIG. 1, and can be formed generally from a rectangular shaped fabric or other material panel, like a strip of fabric (although other shapes could be used to generate a different final shape of a headphone cover). The cover member 202 can comprise a first edge 228 opposite a second edge 230. The first and second edges 228 and 230 can each comprise a linear edge configuration, wherein the first and second edges 228 and 230 are formed generally parallel to each other. Of course, other panel shapes and configurations are contemplated herein. The cover member 202 can further comprise a third edge 231 and a fourth edge 233 opposite the third edge 210, these also being linear and generally parallel to each other, thereby forming the rectangular shaped panel as shown. The third and fourth edges 231 and 233 may have a length selected to accommodate different depths of the earpieces of a particular type of headphone to better accommodate an appropriate fit to the headphone. Similarly, the first and second edges 228 and 230 may have a length selected to accommodate different diameters or outer perimeter profiles (i.e., lengths) of earpieces of a particular headphone. Furthermore, all or some of the components of the protective headphone cover 200 can be made of expandable material, such as an elastic or semi-elastic fabric material so that it may wrap around and cover and conform to a variety of different sized headphones, as further discussed herein. The four edges of the fabric cover panel 202 can define the boundaries of a headphone interface surface 217 that is configured to interface with or bias against at least a portion of an outer side of the earpieces of the headphones (e.g., similar to the interface surface 117 of FIG. 3).

In some examples, the cover member 202 can have at least one opening or aperture 204 formed through a portion of the cover member 202. The aperture 204 can be a hole or a slit through the cover member 202, and can be located and sized to permit passage of a cord or cable, such as an audio cable or power cable that may be plugged into the headphone being covered by the protective headphone cover 200. The aperture 204 can be formed along any portion of, or can be located at any location, on the cover member 202. A larger aperture, or multiple apertures, may be formed through the cover member 202 at strategic locations to accommodate a user accessing various buttons that may be on the covered headphone, such as a power button, Bluetooth sync button, volume buttons, etc. As illustrated in FIG. 6C, the aperture 204 provides convenient user access to input port(s) on the headphone through the protective headphone cover 200, which also allows for a larger protective headphone cover to be used to cover more of the headphone because the protective headphone cover does not need to comprise a smaller profile to accommodate and expose such ports on a headphone.

Figure 5B:
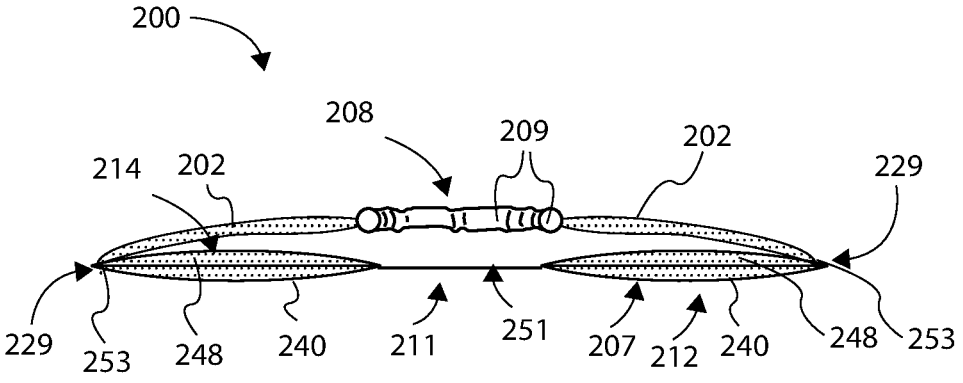
FIG. 5B is a cross-sectional side view of the assembled protective headphone cover of FIG. 5A, taken along lines 5B-5B.

Similarly as discussed above regarding FIGS. 1-3, the protective headphone cover 200 can comprise an elastic locking member 209, which can be attached to the first edge 228 of the cover member 202, to at least partially define an expanding opening 208 (FIGS. 5A-6C), and to function to secure the protective headphone cover 200 to a headphone by contracting to apply a radially inward force to the contacted surface(s) of the headphone. The elastic locking member 209 is shown in a relaxed or un-stretched state in FIG. 4 (and in 5A and 6A), and the dashed rectangular lines above the elastic locking member 209 illustrate that the elastic locking member 209 can be moved to an expanded or stretched state. In one example, the elastic locking member 209 can be stretched to an expanded or partially expanded state and then attached (e.g., sewn) to the first edge 228 of the cover member 202, such that when the elastic locking member 209 is released, it contracts and bunches up the first edge 228 of the cover member 202. In another example, the first edge 230 can be first bundled or bunched along the elastic locking member 209 in an un-stretched state, and then attached to the elastic locking member 209. With each example, and with the cover member 202 attached end to end, the contracted state of the cover member 202 and the elastic locking member 209 can take a shape and form as illustrated in the top view of FIG. 5A and the cross sectional view of FIG. 5B, showing the cover member 202 and the elastic locking member 209 in the contracted or un-stretched state.

Therefore, the first edge 228 of the expandable cover member 202 can have a length L1, and an elastic locking member 209 can have a length L2 (when in the un-stretched state), where length L2 is less than length L1. Thus, the elastic locking member 209 is operable to expand to be the same or similar as length L1 of the first edge 228 of the cover member 202, such as when the expanding opening 208 is expanded to widen the expanding opening 208 and to straighten the cover member 202, such as in preparation for being placed onto an earpiece of the headphones.

The headphone cover 200 can further comprise at least one inner panel 212 (forming an inner cover member (in some examples this also being referred to as an inner side portion)). In the example shown in FIGS. 4-7B, the at least one inner panel can comprise or define a dual-panel assembly 207 (see specifically FIGS. 4 and 5B) attached to the second edge 230 of the cover member 202. In this manner, the dual-panel assembly 207 can comprise a first inner panel 240 having an inner edge 242 that defines a first audio opening 244, and having a perimeter edge 246 extending around and defining a perimeter edge of the first inner panel 240. The first inner panel 240 can comprise a first surface 247 defined along one planar side of the first inner panel 240. The dual-panel assembly 207 can comprise a second inner panel 248 having an inner edge 250 that defines an audio opening 252, and having a perimeter edge 254 that extends around and defines a perimeter of the second inner panel 248. The second inner panel 248 can comprise a surface 256 defined along one planar side of the second inner panel 248. The first and second inner panels 240 and 248 can be configured and caused to be adjacent and congruent with one another (i.e., aligned and positioned or situated side by side one another), and joined to one another to form the dual-panel assembly 207 as part of the protective headphone cover 200. The first and second inner panels 240 and 248 can comprise a shape and configuration as shown in FIGS. 4-5B, or they can comprise other shapes and configurations. Moreover, they can be formed of a fabric material, or materials other than fabric, or a combination of fabric and one or more other materials.

Regarding assembly of the dual-panel assembly 207 (the first and second inner panels 240 and 248), the first surface 247 of the first inner panel 240 can be overlaid onto the second surface 256 of the second inner panel 242, such that the first and second inner panels 240 and 248 are aligned with each other and the respective audio openings 244 and 252 are aligned and concentric with one another. In addition, the aligned and concentric audio openings 244 and 252 can also be aligned and concentric with the expanding opening 208. In one example, the first and second inner edges 242 and 250 can be attached to each other (e.g., sewn) around the entire length of their inner edges to form an inner attachment seam or interface 251 (see FIGS. 5A, 5B and 7A). In one example, the first and second inner edges 242 and 250 can be joined in a manner such that the inner attachment seam 251 is disposed on the inside of the dual panel assembly 207, in between the first and second inner panels 240 and 248, such that the seam is out of view. This can be accomplished by causing the first and second inner edges 242 and 250 to double back on the first and second inner panels 240 and 248. Similarly, the first and second perimeter edges 246 and 254 can be attached to each other (e.g., sewn) around the entire circumferential length of their perimeter edges to form an outer attachment seam or interface 253. The result is the dual-panel assembly 207, which generally has the same shape and size as each of the first or second inner panels 240 and 248. Thus, the first and second audio openings 244 and 252 are aligned and congruently overlaid to each other, such that they combine to define a single audio opening 211 (FIGS. 5A and 5B) that is generally the same shape as each of the first or second audio openings 244 and 252. dual-panel assembly 207 Thus, with the protective headphone cover 200 in use about a pair of headphones, the dual-panel assembly 207 is positionable between the user contact surface of the earpiece of the headphone and the head or ear or both of the user, as explained above. In some examples, more than two fabric panels (similar to inner panels 240 and 248) can be attached together to provide a thicker or greater buffer area or zone between the user and the headphone, and to further absorb moisture and promote airflow, for instance.

Figure 7A:
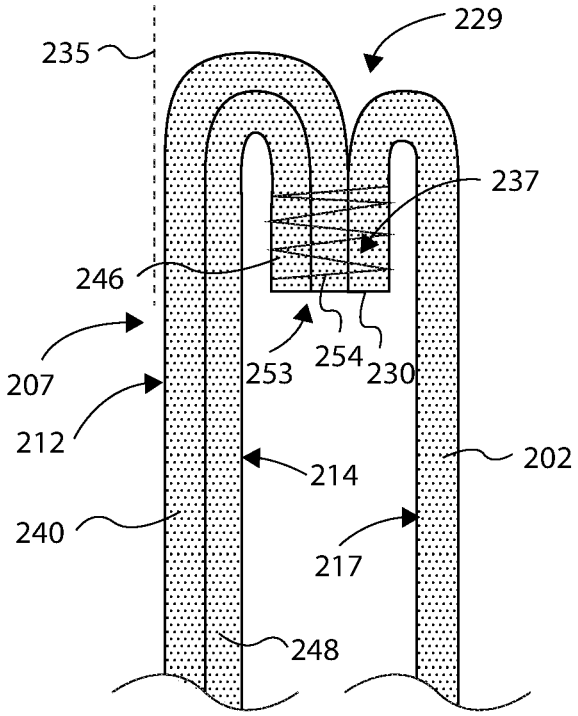
FIG. 7A graphically illustrates in detail the portion of the headphone cover of 5A identified in FIG. 6C by the dotted circle, namely an intermediate joint attachment section of the protective headphone cover, with the headphone cover in a contracted or un-stretched state, such as is shown in FIG. 6A.

Once the first and second inner panels 240 and 248 are attached, this forming the dual-panel assembly 207, the outer attachment seam 253 can be attached to the second edge 230 of the cover member 202, wherein the cover member 202 forms a cylindrical body or configuration, and wherein the dual-panel assembly covers and closes one of the open ends of the cover member 202. In another example, the (unattached) first and second perimeter edges 246 and 254 of the first and second inner panels 240 and 248 can be aligned with the second edge 230 of the cover member 202, and then all three edges (230, 246, 254) can be simultaneously attached together, such as generally shown in FIG. 7A, for instance, which is discussed in more detail below. In either case, the cover member 202 takes on a cylindrical configuration, with the dual-panel assembly 207 enclosing the open end of the cover member 202 about the edge to which it is attached.

Once the cover member 202 is attached to the first and second inner panels 240 and 248 of the dual-panel assembly, the third and fourth edges 231 and 233 (defining respective ends) of the cover member 202 can be attached together (e.g., sewn), wherein the cover member 202 forms a cylindrical body about the dual-panel assembly 207. In one example, the elastic locking member 209 can be attached to the cover member 202 prior to attaching the cover member 202 to the dual-panel assembly 207. As can be appreciated from the above description, the length L1 of the second edge 230 of the cover member 202 can be the same or similar as a circumferential length of each of the first and second inner panels 240 and 248, so that when attached together, the third and fourth edges 231 and 233 would be aligned to each other when aligned with and wrapped around the circumferences or perimeter edges of the first and second inner panels 240 and 248, so that the third and fourth edges 231 and 233 can be appropriately attached or joined to each other (e.g., by sewing). In this manner, ends of the elastic locking member 209 may also be aligned and attached or joined together to form a continuous expanding opening, such as by utilizing sewn fabric, adhesive, or heating applications to connect ends of the elastic locking member 209 together.

Attaching the cover member 202 to the dual-panel assembly 207 generates an intermediate attachment joint section 229 at the attachment intersection of the cover member 202 and first and second inner panels 240 and 248. The intermediate attachment joint section 229 extends around a perimeter of the protective headphone cover 200, and is the point or area at which the cover member 202 may move or pivot or rotate relative to and about the dual-panel assembly 207, as further discussed below.

As shown in the side cross-sectional view of FIG. 5B, with the protective headphone cover 200 in a relaxed state, the first inner panel 240 is overlaid by the second inner panel 248, and the cover member 202 and the attached elastic locking member 209 are overlaid about the second inner panel 248. Thus, the second inner panel 248 is intermediately situated between the first inner panel 240 and the cover member 202. In this manner, the second inner panel 248 is generally hidden from view when the headphone cover 200 is attached to a headphone as its outer surface is juxtaposed or adjacent the user contact surface of the original cover of the earpiece of the headphone. Moreover, with the only exposed surface of the second inner panel 248 being on the inside of the protective headphone cover 200, the second inner panel 248 does not directly come in contact with the user, and is not directly exposed to human oil or sweat or dirt from the user, such as from the user's hands, even though these may seep through the first inner panel 240 if uncleaned. The second inner panel 248 comprises a headphone interface surface 214 configured to interface with or bias against, and to be positioned adjacent and juxtaposed, at least a portion of an original headphone cover of the earpiece of the headphone (similarly to headphone interface surface 114 of FIG. 3). Thus, the second inner panel 248 directly contacts the original headphone cover, and functions as a second layer of the dual-panel assembly 207. Thus, the first inner panel 240, being directly adjacent and in contact with a user's ear/head, is adapted to absorb oils or sweat from the user, while the second inner panel 248 is adapted to function as a buffer to prevent oils or moisture from passing through to the original headphone cover. This helps to prolong the life of the protective headphone cover 200 because it has an inner "hidden" panel (the second fabric panel) that avoids direct contact with the user, thus enhancing the sanitary aspects of the protective headphone cover 200 over a single panel design, even though such is contemplated herein, as discussed above.

Providing the second inner panel 248 in this manner to form the dual-panel assembly 207 also provides additional structural support to the headphone cover 200 to help maintain the at least one inner panel 212 in a planar configuration during use. Because the headphone cover 200 may be comprised of a generally flexible and/or elastic fabric material (e.g., spandex), the headphone cover 200 benefits from the additional structural integrity provided by two layers or panels of material disposed between the user and the original headphone cover as opposed to a single panel or layer. The dual-panel assembly 207 further helps to reduce wear and possible tearing of the material that forms the headphone cover 200 dual-panel assembly 207.

Figure 6A:
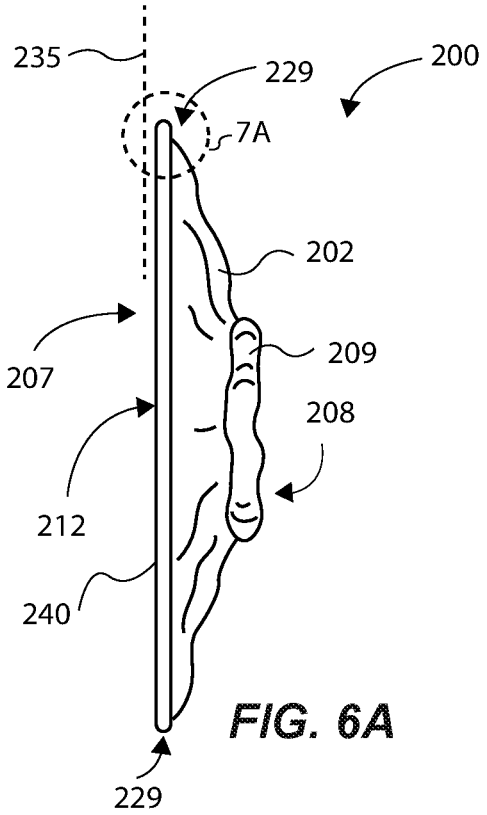
FIG. 6A is a side view of the protective headphone cover of FIG. 5A, showing the headphone cover in a contracted or un-stretched, relaxed state.
Figure 6B:
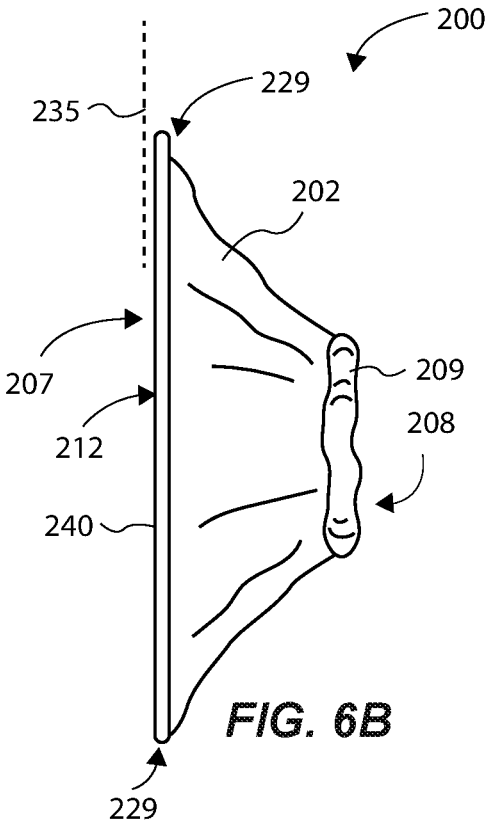
FIG. 6B is a side view of the protective headphone cover of FIG. 5A, showing the headphone cover in a partially expanded or stretched state.
Figure 6C:
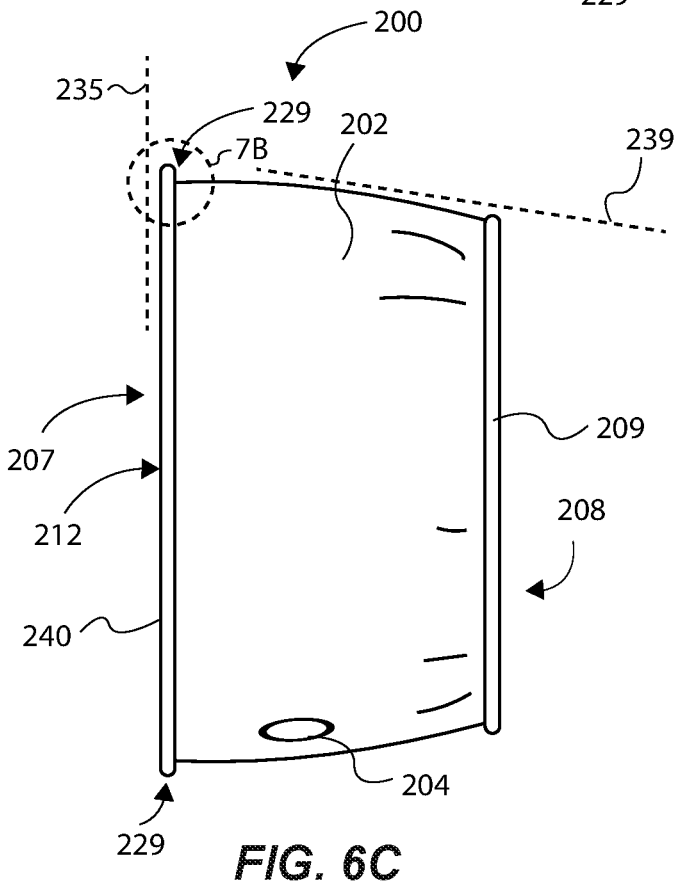
FIG. 6C is a side view of the protective headphone cover of FIG. 5A, showing the headphone cover in a fully expanded and stretched state.

FIGS. 6A-6C illustrate transitioning or moving the assembled protective headphone cover 200 (it is noted that this discussion also applies to the protective headphone cover 100 discussed above) from a relaxed, contracted or un-stretched state (FIG. 6A) to a near fully expanded state (FIG. 6C). Although a headphone is not shown, it will be appreciated that, in use as placed over a headphone, the protective headphone cover 200 will generally be applied to the headphone in the expanded state or nearly expanded state shown in FIG. 6C, similarly as shown in FIGS. 1 and 2, for example, and once applied, permitted to contract to conform to the headphone. In the relaxed state (FIG. 6A), the elastic locking member 209 is not stretched, thus the opening 208 is at its smallest size. Relaxing the elastic locking member 208 to place the protective headphone cover 200 in the relaxed contracted state functions to radially draw inward the cover member 202 towards a central axis (not shown) extending centrally through the opening 208, wherein this further functions to cause the edge of the cover member 202 to which the elastic locking member 208 is attached to bunch up. Relaxing the elastic locking member 208 further functions to cause the cover member 202 to rotate relative to the dual-panel assembly 207 in a direction toward the dual-panel assembly 207, such that the cover member 202 is substantially parallel with the dual-panel assembly 207. Indeed, in this relaxed state, each of the various panel components and the elastic locking member 209 of the protective headphone cover 200 can be oriented substantially parallel to one another and can rest against one another. FIG. 6B shows an intermediate state of the protective headphone cover 200 between the contracted and expanded states to illustrate how the cover member 202 moves relative to the dual-panel assembly 207. Upon expanding the elastic locking member 209 and the expanding opening 208 via stretching the elastic locking member 209 (such as with a user's hands), the cover member 202 can move in various ways. First, the cover member 202 can be caused to expand radially outward away from the central axis, thus widening the opening 208. Furthermore, as the elastic locking member 209 is expanded, the cover member 202 is caused to also move (e.g., pivot or rotate or transition) outwardly generally away from the dual-panel assembly 207 via the intermediate attachment joint section 229 independent of the orientation of the dual-panel assembly 207, and with the dual-panel assembly 207 maintaining a generally planar configuration about plane 235. As such, expanding the elastic locking member simultaneously causes both radial expansion and pivotal movement of the cover member 202, these being relative to a central axis and relative to the dual-panel assembly 207, respectively. Further expansion of the elastic locking member functions to further expand or widen the opening 208, as well as to further radially expand and pivot the cover member 202 (as shown in FIG. 6C). In this expanded configuration, the protective headphone cover 200 is ready to be placed over a headphone. Advantageously, the intermediate attachment joint section 229 can isolate the movement of the cover member 202 from the dual-panel assembly 207, which can permit the cover member 202 to be expanded and retracted as needed to apply and remove the protective headphone cover 200 from a headphone, as well as to not disrupt the planar configuration of the dual-panel assembly 207. It is noted that those skilled in the art will recognize that the protective headphone cover 200 is, in many examples, made of a flexible fabric or other material. As such, movement of any one component, such as the cover member 202, can cause movement of another component, such as the dual-panel assembly 207. The discussion herein is intended to illustrate the functionality of the protective headphone cover 200 with the assumption that the dual-panel assembly 207 is held in a planar formation or configuration.

As shown, the dual-panel assembly 207 can define a first plane 235 that is generally planar, and, when expanded or partially expanded, the cover member 202 can define a second plane 239 that is at a particular angle relative to the first plane 235 depending on the particular makeup and configuration of the protective headphone cover 200, and the amount of expansion of the elastic locking member 209. In the example shown, the cover member 202 can extend along the second plane 239 that is transverse to the first plane 235. In some examples, the cover member 202 can extend along the second plane 239, and the cover member 202 can be pivoted between 0 and 180 degrees relative to and about the dual-panel assembly 207. Typically the protective headphone cover 200 will pivot between the relaxed state and an expanded state, and thus the cover member 202 will pivot generally between 0 and 90 degrees. However, in some cases, additional pivoting may be facilitated by the intermediate attachment joint section 229 (for example, in those cases where the diameter of the headphone is larger than the diameter of the dual-panel assembly 207, or where the diameter of the headphone is smaller than the diameter of the dual-panel assembly 207, such that a portion of the dual-panel assembly 207 is caused to wrap around the headphone onto an outer side of the headphone). Therefore, in other examples, the range of degrees in which the cover member 202 can pivot about the dual-panel assembly 207 can be greater or less than between 0 and 90 degrees. No matter the pivoted position of the cover member 202 relative to the dual-panel assembly 207, the dual-panel assembly 207 can maintain its generally planar shape and configuration due to the hinge-like motion provided by the intermediate attachment joint section 229, and the fact that the intermediate attachment joint section 229 isolates movement of the cover member 202 from the dual-panel assembly 207. Thus, when in use against the inner surface of an original headphone cover, the dual-panel assembly 207 can maintain its planar configuration independent or regardless of the orientation of the cover member 202 as wrapped around and as conforming to an outer side of the headphone. Said another way, the dual-panel assembly 207 remains substantially static relative to movement of the cover member 202, because it is only the cover member 202 that is expanded to wrap or cover the headphone, while the dual-panel assembly 207 merely rests against the inner planar portion of the original headphone cover (e.g., 116 of FIG. 3).

Again, as will be appreciated by those skilled in the art, because the headphone cover 200 is mostly or entirely comprised of a flexible fabric or other material, there will be some slight movement or flexing of the dual-panel assembly 207 when expanding the cover member 202 around a headphone. However, as discussed above, all or a majority portion of the dual-panel assembly 207 can substantially maintain its planar orientation as the cover member 202 is manipulated. In this manner, the dual-panel assembly 207 can define a profile that is similar or the same as the planar inner surface of an original headphone cover, which helps to maintain the original shape of the headphone, as discussed above.

Figure 7B:
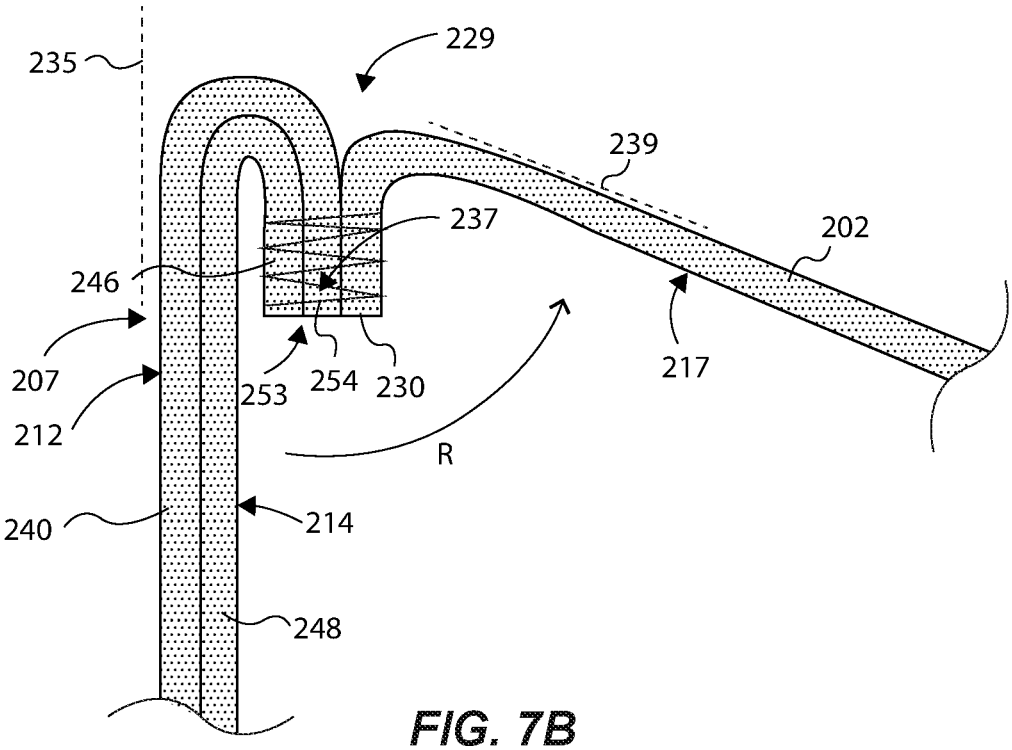
FIG. 7B graphically illustrates in detail the portion of the headphone cover of 5A identified in FIG. 6C by the dotted circle, namely the intermediate joint attachment section with the headphone cover in at least a partially expanded or stretched state, such as is shown in FIG. 6B or 6C.

FIGS. 7A and 7B graphically illustrate the coupling configuration and associated functionality of the intermediate attachment joint section 229 between the cover member 202 and the dual-panel assembly 207 configured as the dual-panel assembly 207. As mentioned above, the headphone interface surface 214 is configured to bias or rest against a user contact surface of the original headphone cover. With respect to FIG. 7A, representing the protective headphone cover 200 in a relaxed state, the cover member 202 and the first and second inner panels 240 and 248 are shown as relatively thick sections of fabric or other material for purposes of illustration without other portions of the components of the headphone cover 200 being shown, and that in reality they could be relatively thin pieces of fabric or other material attached to each other. In the example assembly or joining configuration between the cover member 202 and the dual-panel assembly 207, as shown, the first and second inner panels 240 and 248 of the dual-panel assembly 207 can extend about the first plane 235 and can be configured to transition approximately 180 degrees following a common change in direction, such that the dual-panel assembly 207 is wrapped or turned inward, back on itself a given distance with the perimeter edges 246 and 254 of the first and second inner panels 240 and 248, respectively, extending and terminating a distance back on the dual-panel assembly 207 about a plane parallel to the plane 235. Likewise, the cover member 202 can extend upwardly (about a plane generally parallel the first plane 235) and can be configured to transition approximately 180 degrees, such that the cover member 202 is wrapped or turned inward, back on itself a given distance with the perimeter second edge 230 extending and terminating a distance back on the cover member 202 about a plane parallel to the plane 235. The second edge 230 can terminate at the same distance as the perimeter edges 246 and 254 of the first and second inner panels 240 and 248, with the turned back portions (the edges) of the dual-panel assembly 207 and the cover member 202 coming together and being positioned adjacent one another. These three edges can be attached or joined together, such as by sewing, using threads or a joining fabric and threads, as shown, to generate a panel attachment section 237 that at least partially defines the intermediate attachment joint section 229. Generating the joint attachment section 237 can occur when the three pieces of fabric (240, 248, 202), for instance, are laid flat to each other and inverted, so that after sewing them together, the three assembled fabric panels and the panel attachment section 237 can be inverted or reversed, such that the joint attachment section 237 is mostly or entirely hidden from view from an outside area of the headphone cover 200, as illustrated in FIG. 7A.

Again, with the protective cover panel 200 in the relaxed state, the panel attachment section 237 can extend generally parallel to the first plane 235 (defined by the dual-panel assembly 207) so that panel attachment section 237 is somewhat vertically situated along the dual-panel assembly 207 and the cover member 202. This assists to maintain the generally planar orientation of the dual-panel assembly 207 when moving the cover member 202 relative to the dual-panel assembly 207 because the cover member 202 will generally pivot or rotate about the panel attachment section 237 (see FIG. 7B), while the panel attachment section 237 and the dual-panel assembly 207 may remain substantially static. Pivoting of the headphone panel section 202 is illustrated by the arrow R in FIG. 7B. Said another way, the point about which the cover member 202 rotates or pivots (when the protective headphone cover 200 is being expanded) is positioned offset and (e.g., laterally away) from the first plane 235 and the dual-panel assembly 207. In the example shown, the pivot point of the headphone panel cover 202 is located approximately at the 180 degree bend in the cover member 202. Thus, when expanding the cover member 202 and the expanding opening 208 during normal use, the perimeter edges of the dual-panel assembly 207 substantially maintain their 180 degree bend configuration independent of movement or orientation of the cover member 202. That is, the perimeter edge configuration of the dual-panel assembly 207 at the panel attachment section 237 is not forced out of its 180 degree bend configuration by virtue of expanding the cover member 202 because of the aforementioned structure and functionality of the dual-panel assembly 207, the panel attachment section 237, and the intermediate attachment joint section 229. This contributes to maintaining a generally planar orientation of the dual-panel assembly 207 when expanding the cover member 202, and placing the protective headphone cover 200 onto a headphone.

It is noted, and it will be recognized by those skilled in the art, that although the protective headphone cover 200 comprises a dual-panel assembly, the same features and functionality described above with respect to the protective headphone cover 200, including the intermediate attachment joint section 229 and the pivoting of the cover member relative to the at least one inner panel 212, can be applied or implemented on a protective headphone cover comprising an inner panel comprised of only a single panel (e.g., the protective headphone cover 100 discussed above), or an panel assembly having more than two panels.

Figure 8:
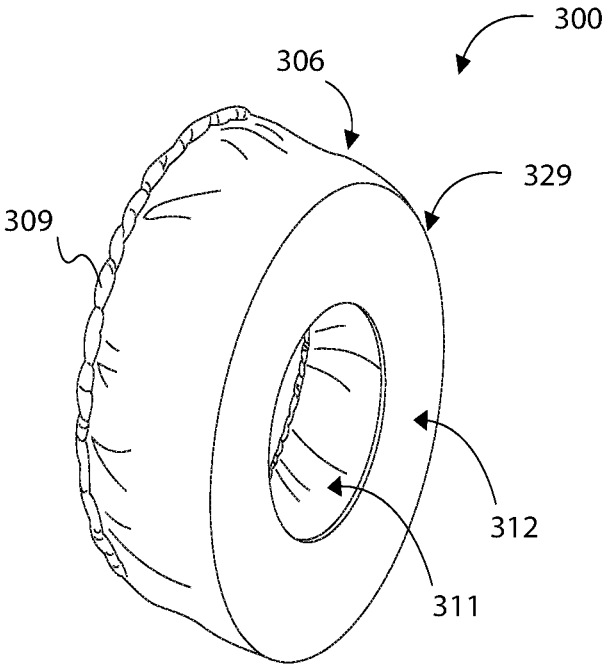
FIG. 8 is an isometric view of a protective headphone cover having an oval configuration or shape, in accordance with an example of the present disclosure.
Figure 10:
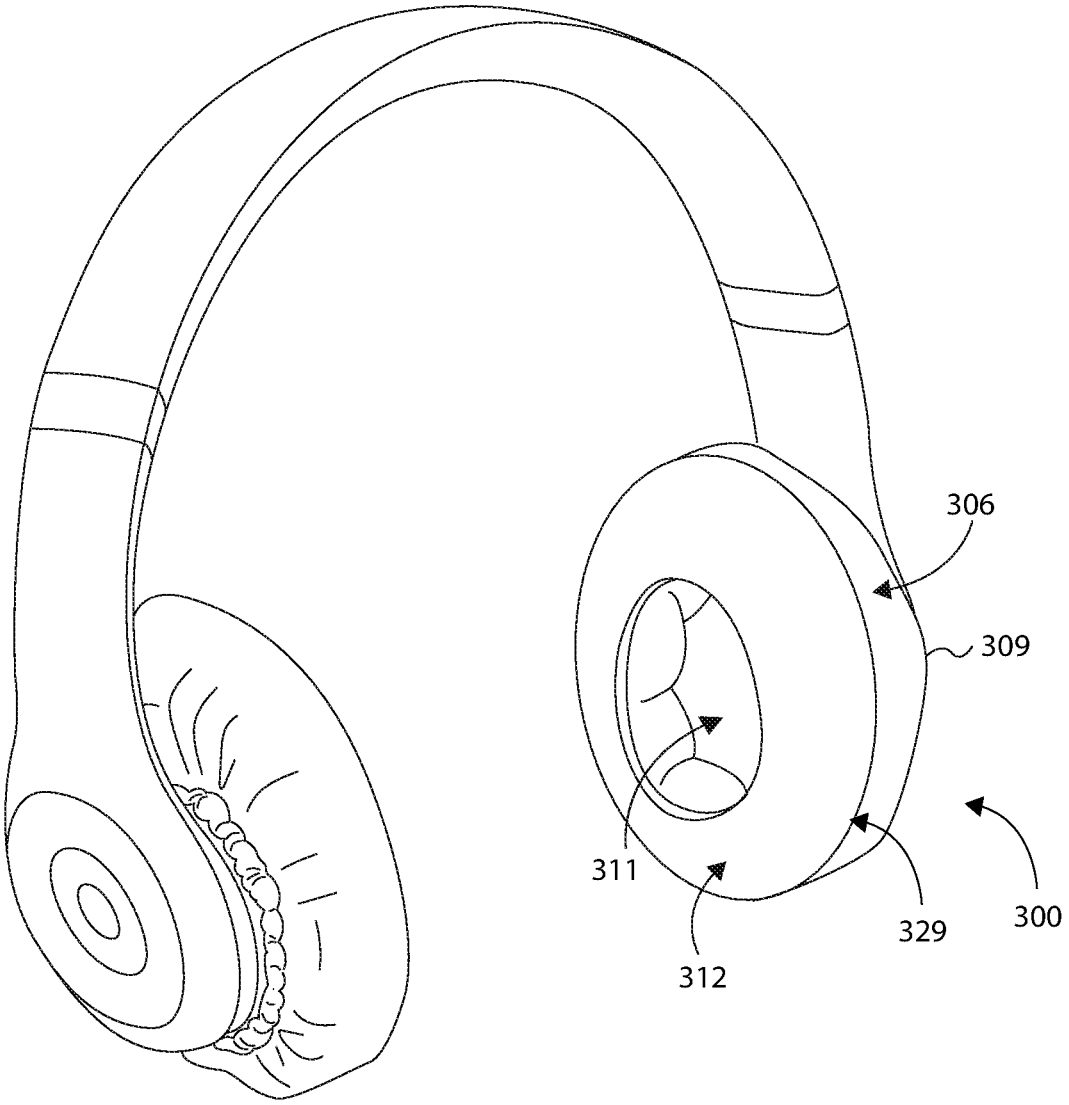
FIG. 10 is an isometric view of protective headphone covers covering the earpieces of headphones in accordance with an example of the present disclosure.

FIG. 8 illustrates another example of a headphone cover 300 that comprises a generally oval shaped profile to accommodate oval shaped headphones. Thus, at least one inner panel 312 (or inner headphone side portion) can be comprised of one or more panels (e.g., a dual-panel assembly), which are generally oval shaped panels that may be comprised of fabric. Therefore, when attaching cover member 306) to the at least one inner panel 312, the cover member 306 would necessarily conform to an oval shaped profile of the inner panel 312 (e.g., the two taking on somewhat of an oval cylinder-shape). Accordingly, an elastic locking member 309, attached to an edge of the cover member 306, could be expanded to conform around the oval shaped headphone. For instance, see FIG. 10, showing left and right headphone covers (e.g., 300) being generally oval shaped, in a vertical direction of the inner panel, to accommodate or wrap around oval shaped headphones. This particular oval shaped headphone cover helps to prevent or avoid distortion of a planar surface of at least one inner panel (e.g., 312) if configured to comprise a circular configuration and if interfaced to the respective oval headphones; distortion that would otherwise exist on side edges of a circular configured headphone cover (e.g., 100) if installed on an oval shaped headphone.

The headphone cover 300 of FIG. 8 (and FIG. 10) can be assembled and can function similarly as described above with respect to the protective headphone cover 200 of FIGS. 4-7B, where the at least one inner panel 312 can define an audio opening 311 sized to permit passage of audio waves therethrough without hindrance of the audio waves. Moreover, the headphone cover 300 can have an intermediate joint attachment section 329 that couples the cover member 306 to the inner panel 312, and that facilitates pivoting or movement of the cover member 306 relative to the inner panel 312, such as further exemplified and discussed above regarding protective headphone cover 200.

Figure 9:
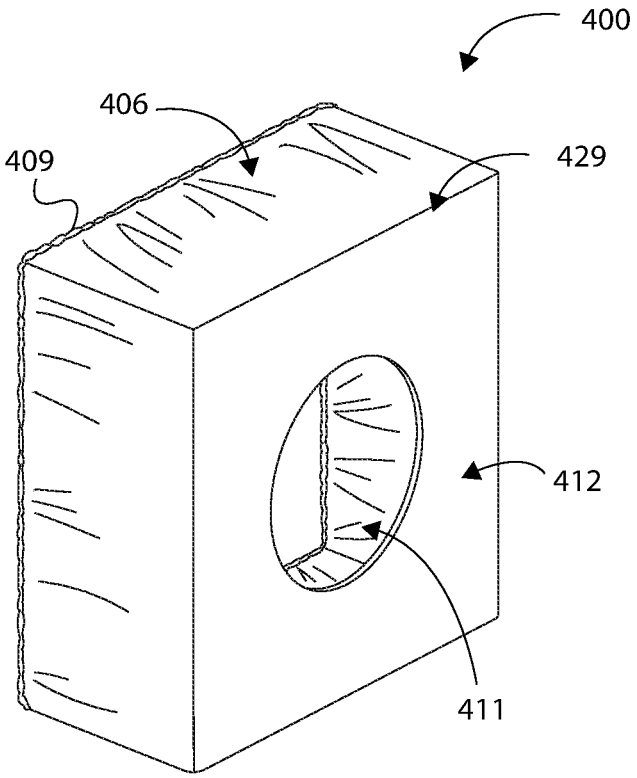
FIG. 9 is an isometric view of a protective headphone cover having a square configuration or shape, in accordance with an example of the present disclosure.

FIG. 9 illustrates another example of a headphone cover 400 that comprises a generally rectangular-shaped profile to better accommodate rectangular shaped headphones (such as many "gamer" headphones). The headphone cover 400 can be assembled and configured, and can function, similarly as any of the protective headphone covers described above. For example, at least one inner panel 412 can be comprised of one or two panels (e.g., a dual-panel assembly), and can be generally rectangular shaped. Therefore, when attaching cover member 406 to the inner panel 412, the cover member 406 can be configured to comprise a rectangular shaped profile when interfaced to a rectangular shaped headphone. Accordingly, an attached elastic locking member 409 could be expanded to conform around such a rectangular headphone.

Moreover, the headphone cover 400 can have an intermediate joint attachment section 429 that couples the cover member 406 to the inner panel 412, and that facilitates pivoting or movement of the cover member 406 relative to the inner panel 412, such as further exemplified and discussed above.

Figure 11A:
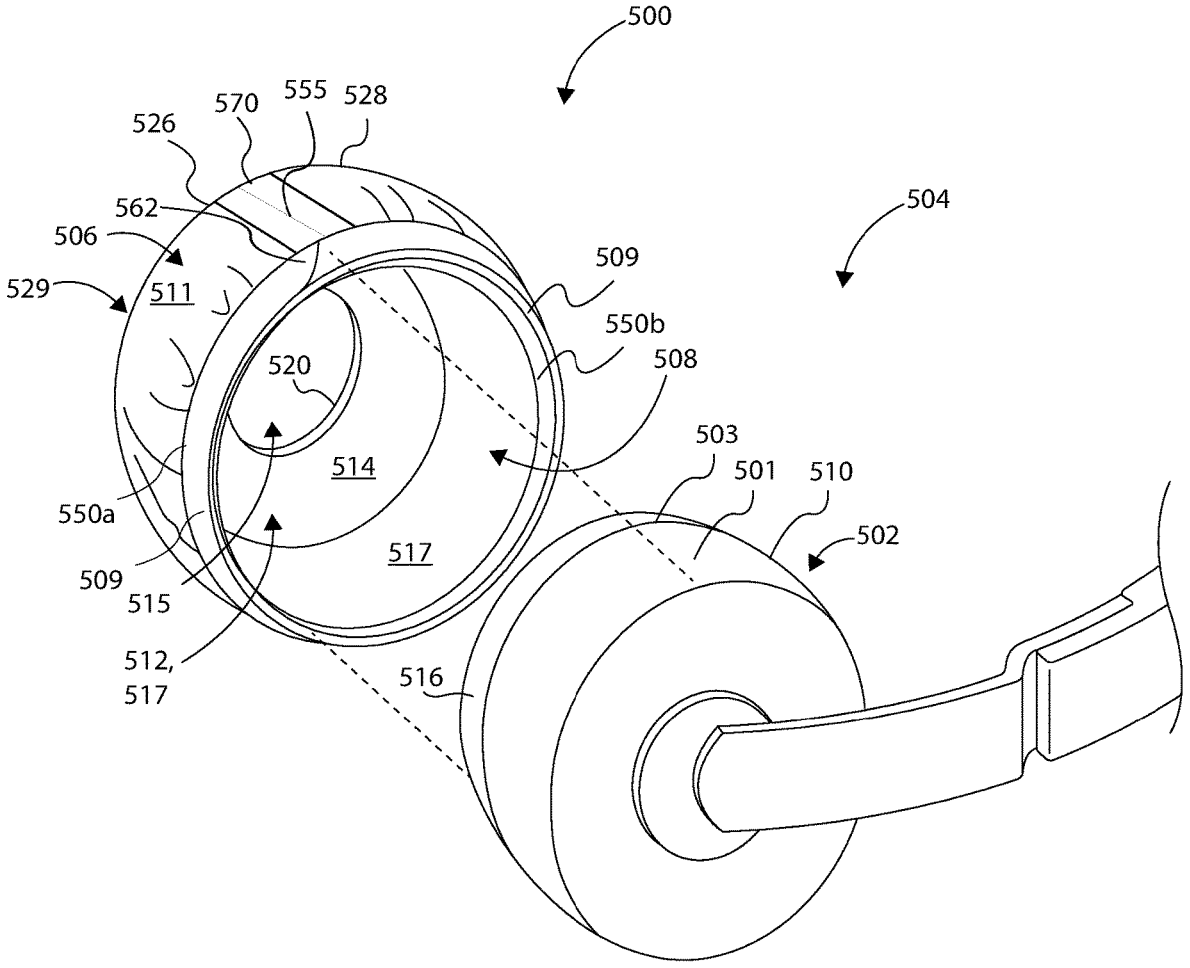
FIG. 11A is a partial isometric view of the example headphone and a protective headphone cover, showing the protective headphone cover exploded from the earpiece of the headphone.
Figure 11B:
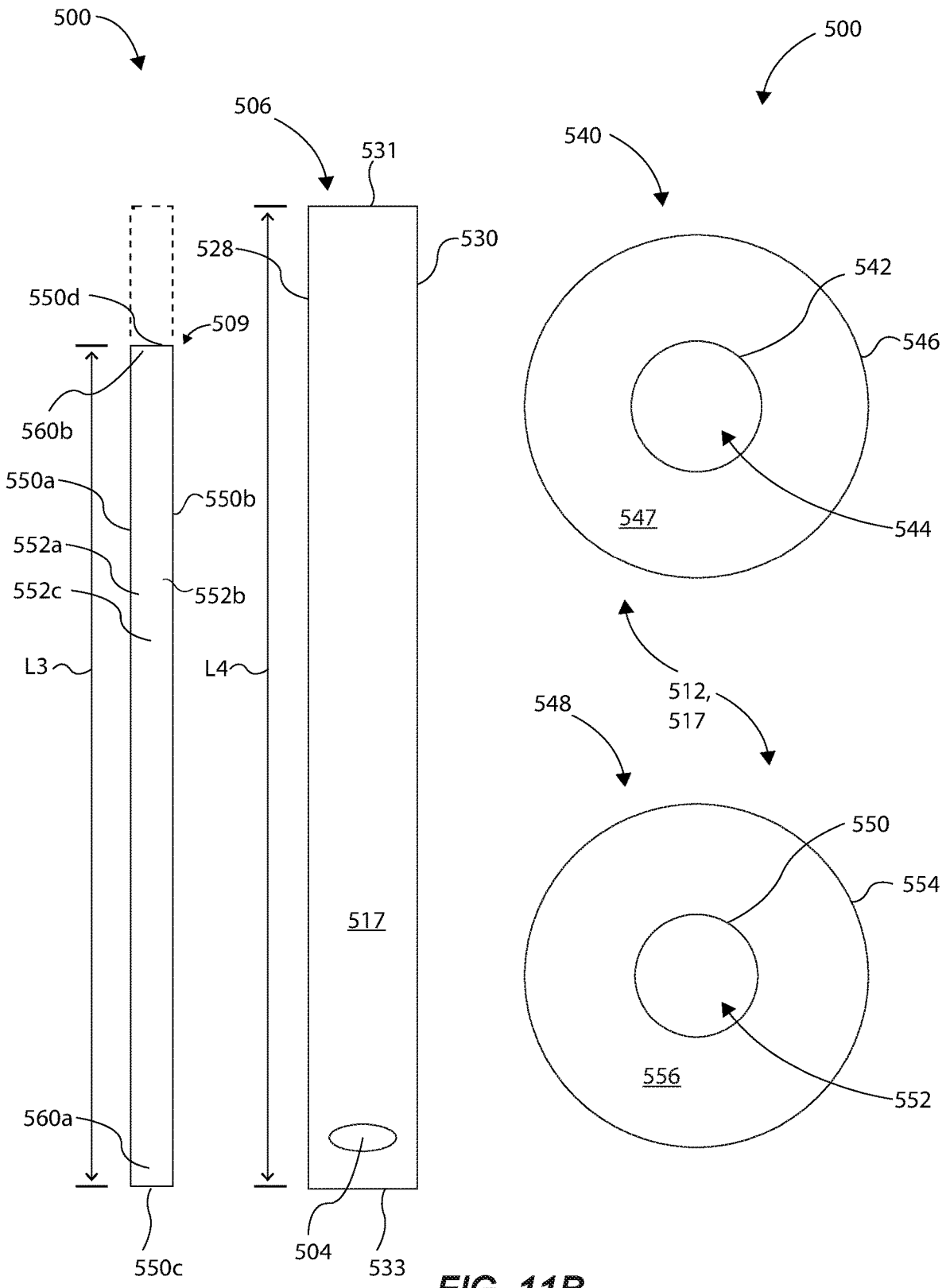
FIG. 11B is a top down plan view of the individual components of the protective headphone cover of FIG. 11A.

FIGS. 11A-11B show aspects of a protective headphone cover 500 for covering an earpiece of an example type of headphone 502, these forming a headphone assembly 504 in accordance with an example of the present disclosure. The headphone assembly 504 can comprise left and right headphones, although FIG. 11A only shows one of such headphone 502 for illustration clarity, with the protective headphone cover 500 exploded or removed from the earpiece of the headphone 502 (with the protective headphone cover 500 also shown in an expanded state).

The protective headphone cover 500 can comprise a cover member 506 having an expanding opening 508 (e.g., an elastic opening) configured to receive an earpiece 501 of the headphone 502, wherein the cover member 506 is configured to wrap around and interface with at least a portion of an outer side surface 510 of the earpiece 501 of the headphone 502. In some examples, the cover member 506 can be referred to as a "fabric cover member" or an "outer side portion" of the headphone cover 500. The expanding opening 508 can be defined by an elastic locking member 509 adhered or bonded or coupled or otherwise secured to an attachment edge 530 (FIGS. 11B-11D) of the cover member 506 (i.e., the expanding opening can comprise an elastic opening), such that the expanding opening 508 is expandable around the earpiece 501 of the headphone 502 to removably attach or couple the protective headphone cover 500 to the earpiece 501 of the headphone 502, with the elastic locking member 509 functioning to secure the protective headphone cover 500 to the headphone by contracting around the headphone, thereby applying a radially inward force about the contacted surface of the headphone. As further discussed below, the protective headphone cover 500 can be flexible so as to be able to accommodate various sized, shaped and configured headphones.

The cover member 506 can comprise a headphone interface surface 517 defining an innermost or interior surface of the cover member 506 of the protective headphone cover 500. The interface surface 517 can be adapted to interface with or bias against at least a portion of an outer surface of the outer side 510 of the headphone 502, as well as an outer surface of an original headphone cover 516 as the protective headphone cover 500 is placed over and conforms to the earpiece 501 of the headphone 502. The cover member 506 can further comprise an outer surface 511 that generally defines an outer perimeter of the protective headphone cover 500. The interface surface 517 and the outer surface 511 can be adapted to be placed onto, and to extend around and provide a cover about, the original headphone cover 516 or the outer side 510 or both of the earpiece 501 of the headphone 502. The outer surface 511 can be one of the surfaces of the protective headphone cover 500 exposed to the environment to provide an initial barrier of protection that functions to protect the headphone 502.

The protective headphone cover 500 can further comprise at least one inner panel 512 (forming an inner cover member or inner side portion (in some examples also being referred to as an inner fabric panel)) attached to the cover member 506, wherein, in one example, the headphone cover 500 can comprise distinct, different component parts, namely the elastic locking member 509, the inner panel 512 (e.g., being comprised of a panel of fabric or other flexible material, as discussed below), and the cover member 506 (e.g., being comprised of a panel of fabric or other flexible material, as discussed below). In another example, however, the inner panel 512 can be integrally formed with the cover member 506 (e.g., formed from the same piece of material). Indeed, in this example, the inner panel 512 and the cover member 506 can be formed from one unitary piece of material, such as fabric, for instance.

The inner panel 512 can comprise a first headphone interface surface 514 configured to interface with or bias against, and to be positioned adjacent to and juxtaposed, at least a portion of the original headphone cover 516 of the earpiece 501 of the headphone 1502, and particularly to interface with and be juxtaposed a user contact surface 503 (or an "inner side surface") of the original headphone cover 516 (see FIG. 1, showing the user contact surface 103 of the original headphone cover 116 being hidden or covered by the inner headphone side portion 112). The original headphone cover 516 can form a part of the earpiece, namely it can comprise the outer fabric or material that covers the soft, cushion member or material or component of the earpiece, the user contact surface being adapted to directly come in contact with the user's head or ear or both during use of the headphones (i.e., without the protective headphone cover 500). The user contact surface of the original headphone cover 516 can be described as that particular surface or portion of the original headphone cover 516 intended to actually directly interface with the head or ear or both of the user. In the example shown, the inner panel 512 of the protective headphone cover 500 can be formed as a generally flat or planar panel.

In use, with the protective headphone cover 500 placed over the earpiece of the headphone 502, the inner panel 512 can be disposed or positioned between the user contact surface of the original headphone cover 516 and the head or ear or both of the user. Of course, those skilled in the art will recognize that application of the same protective headphone cover 500 to headphones of different size, shape or configuration, can cause the inner panel 512 to conform differently, in some cases deviating to a degree from its initial or relaxed planar state. For instance, when the protective headphone cover 500 is positioned over an earpiece of a headphone, the protective headphone cover 500 will conform to the shape of the earpiece, such that the inner panel 512 conforms to the earpiece, and particularly the user contact surface of the earpiece. Depending upon the shape and contour of the user contact surface, the inner panel 512 can be adapted to match and conform to the given contour (e.g., the inner panel can extend along a curve or curved plane, a curvilinear plane, or a combination of these that matches that of the user contact surface earpiece of the headphones).

Note that the original headphone cover 516 can be a cushion member, or it can cover a cushion member, of the headphone 502. Cushions, such as foam, memory foam, polyurethane, and other cushion members or compressible members are traditionally provided with a headphone, such that a flexible fabric (e.g., headphone cover 516) covers the cushion material for comfort and to protect the cushion material from degradation due to external matter, such as sweat, grease, dirt, etc. Accordingly, in this example, the protective headphone cover 500 can be devoid of such cushion member or cushioning material, because the protective headphone cover 500 is provided to cover and protect an existing or original headphone cover 516 and cushion member of the headphone.

The inner panel 512 can have an opening or an audio opening 520 sized and shaped to facilitate passage of audio waves from the audio speaker (see e.g., 118 of FIG. 1A) of the headphone 502 to a user's ear. In one example, the opening can comprise a void, such that there is no physical part of the protective headphone cover 500 within the boundary of the opening. Rather, an inside edge of the inner panel 512 defines and circumscribes the opening 520, such that there are no components or elements or features of the protective headphone cover 500 that extend inwardly into the defined void that would otherwise be situated between the audio speaker 518 and the user's ear when wearing the headphone 502 supporting the protective headphone cover 500. In this example, the opening 520 facilitates unobstructed passage of audio waves through the opening 520

(i.e., the audio waves pass through the opening without coming into contact with or having to pass through material making up the protective headphone cover 500, even though some audio waves not directed through the opening 520 can pass through the protective headphone cover 500). In other examples, the protective headphone cover 500 can comprise an acoustically transparent or semi-transparent screen or panel disposed and supported within the opening 520. In one aspect of this example, an inside edge of the inner panel 512 can still define and circumscribe the opening 520, with the acoustically transparent or semi-transparent screen supported about the inner panel 512 to essentially extend into and cover the opening 520. In still other examples, the inner panel 512 can be formed without an opening, such that the user contact surface of the original cover 516 of the headphone 502 is completely covered by the inner panel 512. The inner panel 512 can be comprised of an acoustically transparent or semi-transparent material, which material can be the same as or different from the cover member 506. In the cases where an acoustically transparent or semi-transparent material is utilized, the protective capabilities of the protective headphone cover 500 will be enhanced over the opening having simply a void as the acoustically transparent or semi-transparent screen can provide an additional protective barrier not present with the void example. The audio opening 520 can be a circular or any other shaped opening. Moreover, the opening 520 can be sized and configured to provide little to no impact on the quality of audio generated by the headphone 502. For example, the opening 520 can be sized and configured so that it maximizes sound transmission from the headphone 502 to the user, and does not inhibit or distort audio waves generated from the audio speaker 518. In some examples, the opening 520 can comprise an area that is between 1-2 inches square. These examples are not meant to be limiting, as the audio opening can be suitably sized and shaped to allow passage of audio waves therethrough without distorting or damping (in those cases where the opening 520 comprises a void (or without noticeably distorting or damping, in those cases where an acoustically transparent screen is utilized)) the audio signal, and without deterring from the principal purpose of the audio opening.

Due to its construction and arrangement of components, the protective headphone cover 500 can conform to the earpiece 501 of the headphone 502. Thus, in some examples, such as where the earpiece 501 of the headphone 502 is generally cylindrically shaped, the protective headphone cover 500 can conform to the various components making up the generally cylindrically shaped earpiece. In one example, the cover member 506 can comprise a rectangular shaped panel or panel member connected end to end to form a cylindrical body, and that is adapted to cover at least a part of the earpiece of the headphone (e.g., the cover member 506 is configured to cover and interface with at least a portion of an outer side 510 or the original cover 516 of the earpiece, or both), and therefore is capable of being generally cylindrically shaped (the shape of the cover member 506 can change, depending on the shape of the earpiece of the headphone 502 or during expansion to/from a relaxed state and a fully expanded state of the protective headphone cover 500).

Note that the protective headphone cover 500 can have the same planes, when coupled to the headphone 502, as discussed above regarding the protective headphone cover 100 of FIG. 1A. Thus, the inner panel 512 can comprise a generally planar configuration when the protective headphone cover 500 is fully expanded, and even when it is placed about and interfaced with the user contact surface of the original cover 516 of the earpiece of the headphone 502, such that this generally planar configuration is independent of the configuration or orientation of the elastic locking member when secured about the headphone 502. That is, despite the positions or orientations of the elastic opening 508 and the cover member 506 as the protective headphone cover 500 is being expanded from a relaxed state to a fully expanded state, or when it is being positioned onto the earpiece of the headphone 502, the inner panel 512 maintains its planar or mostly configuration and orientation ultimately being positioned adjacent to and juxtaposed the planar user contact surface of the original headphone cover 516 (see also FIG. 9 that illustrates this principle). This is discussed in more detail above.

Maintaining the shape and position of the original headphone cover 116 is desirable for comfort of the user, and for purposes of maintaining the original shape and design of the headphones for audio integrity purposes. That is, if the original headphone cover 516 is smashed or distorted due to an attached headphone cover, outside audio signals may enter the user's ear, and some audio signals from the headphone 502 may escape. This could defeat the purpose of having a relatively large, comfortably fitting original headphone cover. Many available headphones have an original headphone cover that is comprised of a vinyl or leather cover over a cushioning ring or member surrounding the audio speaker, for instance. Such cushions are typically quite soft for comfort of the user and are made of material capable of attenuating sound for maximizing audio insulation between the user and the outside environment. Thus, such soft cushions can readily fully compress or be distorted with small amounts of force, such as less than half a pound in some examples. The amount of compliance of the cushion is typically dependent on the size of the user's head, as well as the amount of clamping force against the user that is exerted by the arced headphone coupling member that extends over the top of the user's head to couple left and right headphone earpieces to the user. If such cushioning members are too hard, or are otherwise compressed too much, the user is likely to experience undesirable discomfort around the ears, which necessarily limits the time a user would want to wear the headphones. As mentioned above, this can also affect the sound quality, and thus the experience of the user with the headphones.

Accordingly, the present protective headphone cover 500 is designed in a particular manner and configuration to avoid or prevent such undesirable compression or distortion of the original headphone cover 516 and the cushion rings or cushion member being covered by this. In other words, the protective headphone cover 500 is intended to minimally impact or disrupt the use of the headphones by not distorting any of the original components of the headphones. This is because the inner panel 512 is designed and shaped to remain generally planar against the original headphone cover 516, as discussed above, while the elastic opening 508 and the cover member 506 apply a sufficient force to maintain the headphone cover 500 in a specific position on the headphone 502. In this manner, the inner panel 512 is not "pulled too tightly" against or around the original headphone cover 516 such as to compress or distort the original headphone cover 516 or the cushioning member it is protecting. Rather, the inner panel 512 and the cover member 506 are configured to somewhat float about the original headphone cover 516 with any forces being exerted by the inner panel 512 being insufficient to compress or distort the cushioning member inside the original headphone cover 516, and the majority of securing forces being applied to the earpiece of the headphone 502 by the cover member 506 and the elastic opening 508. This results in a more natural or intended fit of the headphone 502 against or around the user's ear, so that the headphone cover 500 can merely act as a sanitary cover or buffer (as opposed to a constricting device that deforms the original headphone cover 116 to an uncomfortable position or orientation to the user).

In some examples, the inner panel 512 can comprise the same type of fabric or material as the cover member 506, while in other examples the inner panel 512 can comprise a fabric component or material different from the cover member 506. Moreover, the inner panel 512 can be formed of a flat or planar fabric panel that may have a generally curved profile (e.g., circular, oval, curvlinear, etc.) that may be attached at a perimeter edge 526 to a first edge 528 of the cover member 506 to form an intermediate attachment joint section 529. The intermediate attachment joint section 529 can be the area or portion at which the inner panel 512 is attached to or otherwise intersects the cover member 509. In one aspect, the inner panel 512 can comprise two separate components joined together, such as discussed below regarding FIG. 11B. In another example, the cover member 506 can be integrally formed with the inner panel 512 using the same piece of material or fabric. In either scenario, the intermediate attachment joint section 529 can be the area or portion of transition from the generally planar surface of the inner panel 512 positioned in a plane oriented in one direction, to the generally planar surface or shape of the cover member 506 extending about a plane oriented in another direction (e.g., orthogonal with the protective headphone cover 500 in a fully expanded state). The intermediate attachment joint section 529 and the defined transition area or portion is designed and configured to facilitate maintaining the planar orientation of the inner panel 512 independent of the orientation of the cover member 109 when coupled to the headphone 502. An example of this structure and its advantages are discussed above regarding FIGS. 6A-7B.

In one example, the cover member 506 can be formed from a generally rectangular shaped fabric profile (e.g., see FIG. 4) having a second edge 530 opposite the first edge 528 that receives and supports the elastic locking member 509, such as it is coupled or adhered or bonded or otherwise secured to the cover member 506. The elastic locking member 509 can comprise an unexpanded length that is less than a length of the first edge of the cover member 506, wherein the elastic locking member 509 can be expanded to match a length of the first edge of the cover member 506, and then joined along the full length of the first edge of the cover member 506. Thus, the first edge can comprise a bunched, drawn-in configuration upon the elastic locking member 509 being contracted and in a relaxed state. Thus, the elastic locking member 509 may draw in and bunch or bundle the second edge 530, wherein the elastic opening 508 is narrowed. Moreover, the elastic locking member 509 facilitates the protective headphone cover 500 being movable from a contracted state (e.g., see FIGS. 5 and 6) to an expanded state (e.g., see FIGS. 1-3), and back to the contracted state, by a user opening or expanding the opening 508 of the headphone cover 500, such as would be the case as the protective headphone cover 500 is being installed onto and around the earpiece of the headphone 502.

The cover member 506, the inner panel 512, and the elastic locking member 509 can be attached to each other by various means, such as via sewn threads, adhesive applications, or other suitable applications of attachment known by those skilled in the art. The cover member 506 and the inner panel 512 can be formed of a variety of fabrics or materials both natural and/or synthetic, such as spandex material, nylon, natural fabrics, woven fabrics, polyester, synthetic fabrics, blended fabrics, Gore-Tex, a combination of these, or any others as will be apparent to those skilled in the art. Some or all of these materials can be absorbent and/or breathable to minimize the amount of heat generated and any resulting sweat or moisture having the potential to pass through the headphone cover 500 to the headphone 502. The elastic locking member 509 can be comprised of an elastic material, such as synthetic fiber(s) or material(s), or natural material(s). In one example, the elastic locking member 509 can comprise an elastic strip panel (e.g., a strip of material or fabric that stretches) or elastic strap that is joined or adhered or sewn to the cover member 506, as detailed below.

The cover member 506 can be formed generally from a rectangular shaped fabric or other material panel, like a strip of fabric (although other shapes could be used to generate a different final shape of a headphone cover). The cover member 506 can comprise a first edge 528 opposite a second edge 530. The first and second edges 528 and 530 can each comprise a linear edge configuration, wherein the first and second edges 528 and 530 are formed generally parallel to each other. Of course, other panel shapes and configurations are contemplated herein. For purposes of clarification, an "edge" as used herein can be defined as the outside limit of an object, area, or surface, and/or a place or part farthest away from the center of something. That is, an edge is not merely an area of attachment for one component to another component. Rather, an edge can be defined, as shown, and the first edge 528 and the second edge 530, which are the outside limits of the cover member 506, being a thin, flat fabric panel, for instance.

The cover member 506 can further comprise a third edge 531 and a fourth edge 533 opposite the third edge 531, these also being linear and generally parallel to each other, thereby forming the rectangular shaped panel as shown. The third and fourth edges 531 and 533 may have a length selected to accommodate different depths of the earpieces of a particular type of headphone to better accommodate an appropriate fit to the headphone. Similarly, the first and second edges 528 and 530 may have a length selected to accommodate different diameters or outer perimeter profiles (i.e., lengths, shapes, etc.) of earpieces of a particular headphone. The four edges of the fabric cover panel 502 can define the boundaries of the headphone interface surface 517 that is configured to interface with or bias against at least a portion of an outer side of the earpieces of the headphones.

In some examples, the cover member 506 can have at least one opening or aperture 504 formed through a portion of the cover member 506. The aperture 504 can be a hole or a slit through the cover member 506, and can be located and sized to permit passage of a cord or cable, such as an audio cable or power cable that may be plugged into the headphone being covered by the protective headphone cover 500. The aperture 504 can be formed along any portion of, or can be located at any location, on the cover member 506. A larger aperture, or multiple apertures, may be formed through the cover member 506 at strategic locations to accommodate a user accessing various buttons that may be on the covered headphone, such as a power button, Bluetooth sync button, volume buttons, etc.

Similarly as discussed above regarding FIGS. 1-7B, the protective headphone cover 500 can comprise the elastic locking member 509 joined or adhered or attached to the first edge 528 of the cover member 506, to at least partially define an expanding opening 508 (e.g., an elastic opening) (see e.g., FIGS. 5A-6C), and to function to secure the protective headphone cover 500 to a headphone by contracting to apply a radially inward force to the contacted surface(s) of the headphone. The elastic locking member 509 is shown in a relaxed or un-stretched state in FIG. 11B, and the dashed rectangular lines above the elastic locking member 509 illustrate that the elastic locking member 509 can be moved to an expanded or stretched state. In one example, the elastic locking member 509 can be stretched to an expanded or partially expanded state and then attached (e.g., adhered) to the first edge 528 of the cover member 506, such that when the elastic locking member 509 is released, it contracts, thus also contracting the first edge 528 of the cover member 506. In another example, the first edge 530 can be first bundled or bunched along the elastic locking member 509 in an un-stretched state, and then attached to the elastic locking member 509.

Therefore, the first edge 528 of the expandable cover member 2502 can have a length L3, and an elastic locking member 509 can have a length L4 (when in the un-stretched state), where length L4 is less than length L3. Thus, the elastic locking member 509 is operable to expand to be the same or similar as length L3 of the first edge 528 of the cover member 506, such as when the elastic opening 508 is expanded to widen the expanding opening 508 and to straighten the cover member 506, such as in preparation for being placed onto an earpiece of the headphones.

The headphone cover 500 can further comprise at least one inner panel 512 (forming an inner cover member, which can comprise or define a dual-panel assembly 507 (see e.g., FIGS. 4 and 5B) attached to the second edge 530 of the cover member 506. In this manner, the dual-panel assembly 507 can comprise a first inner panel 540 having an inner edge 542 that defines a first audio opening 544, and having a perimeter edge 546 extending around and defining a perimeter edge of the first inner panel 540. The first inner panel 540 can comprise a first surface 547 defined along one planar side of the first inner panel 540. The dual-panel assembly 507 can comprise a second inner panel 548 having an inner edge 550 that defines an audio opening 552, and having a perimeter edge 554 that extends around and defines a perimeter of the second inner panel 548. The second inner panel 548 can comprise a surface 556 defined along one planar side of the second inner panel 548. The first and second inner panels 540 and 548 can be configured and caused to be adjacent and congruent with one another (i.e., aligned and positioned or situated side by side one another), and joined to one another to form the dual-panel assembly 5207 as part of the protective headphone cover 500. The first and second inner panels 540 and 548 can comprise a shape and configuration as shown in FIG. 11B, or they can comprise other shapes and configurations. Moreover, they can be formed of a fabric material, or materials other than fabric, or a combination of fabric and one or more other materials.

Regarding assembly of the dual-panel assembly 507 (the first and second inner panels 540 and 548), the first surface 547 of the first inner panel 540 can be overlaid onto the second surface 556 of the second inner panel 542, such that the first and second inner panels 540 and 548 are aligned with each other and the respective audio openings 544 and 552 are aligned and concentric with one another. In addition, the aligned and concentric audio openings 544 and 552 can also be aligned and concentric with the expanding opening 508. In one example, the first and second inner edges 542 and 550 can be attached to each other (e.g., sewn) around the entire length of their inner edges to form an inner attachment seam or interface (see e.g., 251 of FIGS. 5A, 5B and 7A). In one example, the first and second inner edges 542 and 550 can be joined in a manner, such that the inner attachment seam (e.g., 251) is disposed on the inside of the dual panel assembly 507, in between the first and second inner panels 540 and 548, such that the seam is out of view. This can be accomplished by causing the first and second inner edges 542 and 550 to double back on the first and second inner panels 540 and 548. Similarly, the first and second perimeter edges 546 and 554 can be attached to each other (e.g., sewn) around the entire circumferential length of their perimeter edges to form an outer attachment seam or interface (see e.g., 253 of FIG. 5B). The result is the dual-panel assembly 507, which generally has the same shape and size as each of the first or second inner panels 540 and 548. Thus, the first and second audio openings 544 and 552 are aligned and congruently overlaid to each other, such that they combine to define a single audio opening 515 (FIG. 11A) that is generally the same shape as each of the first or second audio openings 544 and 552. Thus, with the protective headphone cover 500 in use about a pair of headphones, the dual-panel assembly 507 is positionable between the user contact surface of the earpiece of the headphone and the head or ear or both of the user, as explained above. In some examples, more than two fabric panels (similar to inner panels 540 and 548) can be attached together to provide a thicker or greater buffer area or zone between the user and the headphone, and to further absorb moisture and promote airflow, for instance.

Once the first and second inner panels 540 and 548 are attached, this forming the dual-panel assembly 507, the outer attachment seam (e.g., 253) can be attached to the second edge 530 of the cover member 506, wherein the cover member 506 forms a cylindrical body or configuration, and wherein the dual-panel assembly covers and closes one of the open ends of the cover member 506. In another example, the (unattached) first and second perimeter edges 546 and 554 of the first and second inner panels 540 and 548 can be aligned with the second edge 530 of the cover member 506, and then all three edges (530, 546, 554) can be simultaneously attached together, such as generally shown in the example of FIG. 7A, for instance, which is discussed in more detail above. In either case, the cover member 506 takes on a cylindrical configuration, with the dual-panel assembly 507 enclosing the open end of the cover member 506 about the edge to which it is attached.

Once the cover member 506 is attached to the first and second inner panels 540 and 548 of the dual-panel assembly, the third and fourth edges 531 and 533 (defining respective ends) of the cover member 506 can be attached together. In one example, the third and fourth edges 531 and 533 can be overlaid upon one another and adhered together with an adhesive, such as a fabric glue or adhesive, to generate a seamless interface 555 (see dotted line representing the interface of third and fourth edges 531 and 533 of the cover member 506 in FIG. 11A). In another example, the third and fourth edges 531 and 533 can be secured together using one or more separate edge joining members (e.g., see edge joining member 570 in FIG. 11A) that can be bonded to the cover member 506, namely near or about its ends and each of the third and fourth edges 531 and 533, as well as to the interface surface 517, the outer surface 511, or both. The separate edge joining member can comprise an adhesive bonding tape that can be applied to the cover member 506 using heat. Indeed, the adhesive bonding tape can comprise a backing or other supporting structural member (e.g., material, fabric, or any other type of structural member capable of supporting an adhesive layer) in support of an adhesive layer (not shown, but similar to the adhesive layer disposed and supported on the elastic locking member 509, discussed below), which can facilitate the bonding of the edge joining member 570 to the cover member 506. The edge joining member 570 can be overlaid over one or both of the interface and outer surfaces 517 and 511 of the cover member 506 once the third and fourth edges 531 and 533 are brought together, and the adhesive heat (and/or pressure) activated to cause the adhesive to facilitate a bond between the edge joining member 570 and the cover member 506.

Once the third and fourth edges 531 and 533 are joined together, the cover member 506 forms a cylindrical body about the dual-panel assembly 507. In one example, the elastic locking member 509 can be attached to the cover member 506 prior to attaching the cover member 506 to the dual-panel assembly 507, as detailed below. As can be appreciated from the above description, the length L3 of the second edge 530 of the cover member 506 can be the same or similar as a circumferential length of each of the first and second inner panels 540 and 548, so that when attached together, the third and fourth edges 531 and 533 would be aligned to each other when aligned with and wrapped around the circumferences or perimeter edges of the first and second inner panels 540 and 548, so that the third and fourth edges 531 and 533 can be appropriately attached or joined to each other (e.g., by adhesive). In this manner, ends of the elastic locking member 509 may also be aligned and attached or joined together to form a continuous expanding opening, such as by utilizing adhesive and/or heating applications to connect ends of the elastic locking member 509 together, and to attach the elastic locking member 508 to the cover member 506, as detailed below.

Attaching the cover member 506 to the dual-panel assembly 507 generates an intermediate attachment joint section 529 at the attachment intersection of the cover member 506 and first and second inner panels 540 and 548. The intermediate attachment joint section 529 extends around a perimeter of the protective headphone cover 500, and is the point or area at which the cover member 506 may move or pivot or rotate relative to and about the dual-panel assembly 507, as further discussed above in other examples.

As similarly discussed above regarding the example of FIG. 5B, the second inner panel 548 of the protective headphone cover 500 is intermediately situated between the first inner panel 540 and the cover member 506. In this manner, the second inner panel 548 is generally hidden from view when the headphone cover 500 is attached to a headphone as its outer surface is juxtaposed or adjacent the user contact surface of the original cover of the earpiece of the headphone. Moreover, with the only exposed surface of the second inner panel 548 being on the inside of the protective headphone cover 500, the second inner panel 548 does not directly come in contact with the user, and is not directly exposed to human oil or sweat or dirt from the environment or the user, such as from the user's hands, even though these may seep through the first inner panel 540 if uncleaned. The second inner panel 548 comprises the headphone interface surface 514 configured to interface with or bias against, and to be positioned adjacent and juxtaposed, at least a portion of an original headphone cover of the earpiece of the headphone (similarly to headphone interface surface 114 of FIG. 3). Thus, the second inner panel 548 directly contacts the original headphone cover, and functions as a second layer of the dual-panel assembly 507. Thus, the first inner panel 540, being directly adjacent and in contact with a user's ear/head, is adapted to absorb oils or sweat from the user, while the second inner panel 548 is adapted to function as a buffer to prevent oils or moisture from passing through to the original headphone cover. This helps to prolong the life of the protective headphone cover 500 because it has an inner "hidden" panel (the second fabric panel) that avoids direct contact with the user, thus enhancing the sanitary aspects of the protective headphone cover 500 over a single panel design, even though such is contemplated herein, as discussed above.

Providing the second inner panel 548 in this manner to form the dual-panel assembly 507 also provides additional structural support to the headphone cover 500 to help maintain the at least one inner panel 512 in a planar configuration during use. Because the headphone cover 500 may be comprised of a generally flexible and/or elastic fabric material (e.g., spandex), the headphone cover 500 benefits from the additional structural integrity provided by two layers or panels of material disposed between the user and the original headphone cover as opposed to a single panel or layer. The dual-panel assembly 507 further helps to reduce wear and possible tearing of the material that forms the headphone cover 500 dual-panel assembly 507.

It should be appreciated that the headphone cover 500 can have all of the same or similar structure and functionality of the headphone cover 200 described above, particularly regarding the discussion of FIGS. 6A-7B.

As introduced above, the elastic locking member 509, which can be an elastic strip panel (e.g., flat panel), can be joined (e.g., adhered or bonded or glued) to the first edge 528 of the cover member 506. More specifically, in the example shown in FIGS. 11C and 11D, the elastic locking member 509 is shown in an un-attached position (FIG. 11C) and in the attached or joined position (FIG. 11D) to the cover member 506. In the joined position, the elastic locking member 509 is wrapped around or folded over the first edge 528 of the cover member 506, such that the elastic locking member 509 entirely covers or conceals the first edge 528. In one example, the elastic locking member 509 can comprise a generally rectangular shaped panel (prior to joining to the cover member 506), and therefore the elastic locking member 509 can comprise first, second, third, and fourth elastic edges 550*a-d* (FIG. 11B). The elastic locking member 509 can further comprise a first inner surface portion 552*a*, a second inner surface portion 552*b*, and a middle elastic portion 552*c* that is situated laterally between the first and second inner surface portions 552*a* and 552*b*. These portions 552*a-c* extend the length of the elastic locking member 509 from the third elastic edge 550*c* to the fourth elastic edge 550*d*, and can define an inner attachment surface 553.

Figure 11C:
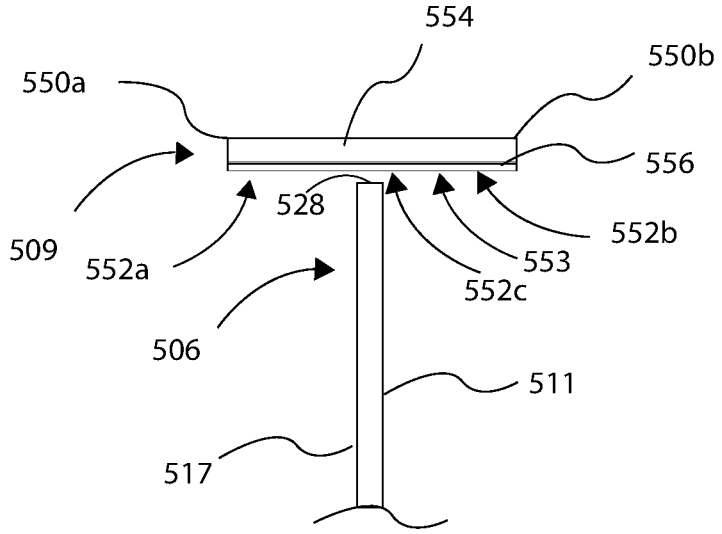
FIG. 11C is a side plan view of the elastic locking member un-attached to the cover member of the headphone cover of FIG. 11B.
Figure 11D:
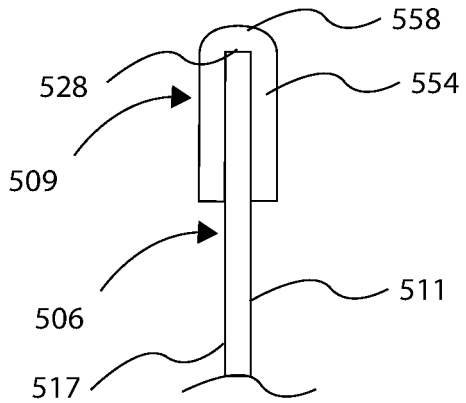
FIG. 11D is a side plan view of the elastic locking member joined or attached to the cover member of the headphone cover of FIG. 11C.

In one example, as shown in FIG. 11C, the elastic locking member 509 can comprise single-sided adhesive tape, which can include an exposed fabric panel 554 and an adhesive film layer 556 disposed along the entire inner attachment surface 553. Therefore, the elastic locking member 509 can be adhered to the cover member 506 to protect and conceal the first edge 528, and to provide or generate the elastic opening 508 of the protective headphone cover 500. Accordingly, as illustrated in FIG. 11D, the elastic locking member 509 can be wrapped around or folded over the first edge 528 of the cover member 506 and adhered to the interface surface 517 and the outer surface 511 of the cover member 506, such that the first inner surface portion 552*a* of the elastic locking member 509 is interfaced and joined/bonded to the interface surface 517 of the cover member 506, and such that the second inner surface portion 552*b* is interfaced and joined/bonded to the outer surface 511 of the cover member 506. Thus, the middle elastic portion 552*c* covers or wraps around the first edge 528 of the cover member 506.

Indeed, the entirety of inner attachment surface 553 can be bonded to the interface and outer surfaces 511 and 517, and to the first edge 528, of the cover member 506 via the adhesive film layer 556. This configuration generates a protective outer edge 558 of the elastic locking member 509 that is exposed about the expanding opening 508 for protecting the first edge 528 of the cover member 506.

In one example, the adhesive film layer 556 can be activated upon the application of heat, pressure or both heat and pressure applied to the outer surface of the exposed fabric panel 554, such that the adhesive film layer 556 transitions from a solid to a liquid upon the application of heat, and then transitions back to a solid upon the removal of heat to bond the elastic locking member 509 to the cover member 506. As a result, the second elastic edge 550*b* extends circumferentially or continuously about the interface surface 517 of the cover member 506, while the first elastic edge 550*b* extends circumferentially or continuously about the outer surface 511 of the cover member 506 (see FIG. 11A). The adhesive film layer 556 can be supported on the elastic locking member 509 prior to the elastic locking member 509 being applied and secured to the cover member 506.

In one example, the elastic locking member 509 can comprises a first end attachment section 560*a* (including the third edge 550*c*), and a second end attachment section 560*b* (including the fourth edge 550*d*). When assembled, the first and second end attachment sections 560*a* and 560*b* can be joined and adhered together, such as by utilizing a section of the adhesive film layer 556 that is overlapped to an outer section of the exposed fabric panel 554, and then heat activated to join together the end attachment sections 550*a* and 550*d*. This provides a rugged attachment means that provides a relatively strong joint section 562 between the end attachment sections 550*a* and 550*d* of the elastic locking member 509. In a non-limiting example, the elastic locking member 509 can be between 300-500 micro meters thick, and can have a width between 8 mm to 20 mm, and can have a length of 10 cm to 40 cm, depending on the particular design, although other dimensions are contemplated herein.

In a non-limiting example, the elastic locking member 509 can comprise a fabric mixture of polyamide and elastane, such as 73% polyamide 27% elastane, which can be coated on one side with the adhesive film layer 556. In an example, the adhesive can comprise thermoplastics polyurethanes adhesive (TPU glue). However, this is not intended to be limiting in any way as other adhesives can be used. In a non-limiting example, a taping machine can be utilized to apply heat and pressure to the elastic locking member 509 to join with the cover member 506.

The above example of bonding/adhering the elastic locking member 509 to the cover member 506 provides an aesthetically pleasing appearance, and a much stronger attachment means than by merely sewing with a thread, for instance. The above example of bonding/adhering the elastic locking member 509 to the cover member 506 also helps to cover larger headphones as compared to using another elastic locking member (e.g., 109, 209), because such elastic members that are sewn to the cover member 506 only stretch so far before either breaking or having the threads rupture, particularly when repeatedly stretched or expanded when applying and removing the headphone cover(s). Furthermore, bonding/adhering the elastic locking member 509 provides a much more aesthetically appealing look and finish as compared to an elastic locking member that is sewn to the cover member 506.

It is to be understood that the above-referenced arrangements are only illustrative of the application for the principles of the present invention. Numerous modifications and alternative arrangements can be devised without departing from the spirit and scope of the present disclosure. Furthermore, while the disclosure has been shown in the drawings and described above with particularity and detail in connection with what is presently deemed to be the most practical embodiments(s), it will be apparent to those of ordinary skill in the art that numerous modifications can be made without departing from the principles and concepts herein as set forth in the claims.

Reference was made to the examples illustrated in the drawings, and specific language was used herein to describe the same. It will nevertheless be understood that no limitation of the scope of the technology is thereby intended. Alterations and further modifications of the features illustrated herein, and additional applications of the examples as illustrated herein, which would occur to one skilled in the relevant art and having possession of this disclosure, are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. One skilled in the relevant art will recognize, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A protective headphone cover, comprising:

a cover member adapted to interface with an outer side surface of a headphone, the cover member comprising a first edge and an opposing second edge;

an elastic locking member adhered to the first edge of the cover member and supported about an expanding opening in the cover member, the elastic locking member being adapted to wrap around the outer side surface of the headphone and to secure the protective headphone cover in place about the headphone; and at least one inner panel having a perimeter edge attached to the second edge of the cover member, and configured to interface with an inner side surface of the headphone.

2. The protective headphone cover of claim 1, wherein the elastic locking member comprises an elastic strip panel wrapped around the first edge of the cover member.

3. The protective headphone cover of claim 2, wherein the elastic strip panel is folded over the first edge of the cover member and conceals the first edge.

4. The protective headphone cover of claim 1, wherein the cover member comprises an interface surface and an outer surface, the first edge of the cover member being defined between the interface surface and the outer surface, and wherein a first inner surface portion of the elastic locking member is attached to the interface surface of the cover member, and a second inner surface portion of the elastic locking member is attached to the outer surface of the cover member, such that the first edge of the cover member is concealed by the elastic locking member.

5. The protective headphone cover of claim 1, wherein the elastic locking member comprises a rectangular panel shape prior to being joined to the cover member.

6. The protective headphone cover of claim 1, wherein the elastic locking member comprises a first elastic edge and an opposing second elastic edge, and a middle elastic portion situated between the first and second elastic edges, wherein the middle elastic portion receives and covers the first edge of the protective headphone cover.

7. The protective headphone cover of claim 6, wherein the first elastic edge extends circumferentially about an interface surface of the cover member, and wherein the second elastic edge extends circumferentially about an outer surface of the cover member.

8. The protective headphone cover of claim 1, wherein the elastic locking member comprises a first end attachment section and a second end attachment section joined together.

9. The protective headphone cover of claim 8, wherein the first end attachment section and the second end attachment section are overlapped to each other and adhered together via an adhesive.

10. The protective headphone cover of claim 1, wherein the elastic locking member is heat adhered to the first edge of the cover member using an adhesive, and wherein ends of the elastic locking member are heat adhered together using an adhesive.

11. The protective headphone cover of claim 1, wherein the elastic locking member comprises single-sided adhesive tape.

12. The protective headphone cover of claim 1, wherein the elastic locking member comprises an inner attachment surface and an outer exposed surface, wherein the inner attachment surface comprises an adhesive film layer disposed along the entire inner attachment surface, so as to facilitate bonding of the inner attachment surface to the cover member.

13. The protective headphone cover of claim 12, wherein the adhesive film layer is heat activated, such that the application of heat to the elastic locking member and the cover member activates the adhesive film layer to bond the elastic locking member to the first edge of the cover member.

14. The protective headphone cover of claim 1, wherein the at least one inner panel is comprised of a fabric material configured to cover at least of portion of a cushion of the headphone.

15. The protective headphone cover of claim 1, wherein the cover member and the at least one inner panel each comprise an elastic fabric material.

16. The protective headphone cover of claim 1, wherein the at least one inner panel comprises a first inner panel and a second inner panel operable to form a dual-panel assembly, each of the first and second inner panels having an audio opening and a perimeter edge, the perimeter edges of each of the first and second inner panel being coupled to each other and attached to the second edge of the cover member.

17. The protective headphone cover of claim 1, further comprising an edge joining member securing together third and fourth edges of the cover member, the edge joining member comprising an adhesive layer.

18. A protective headphone cover, comprising:

a cover member adapted to interface with an outer side surface of a headphone, the cover member comprising a first edge and a second edge;

an elastic strip panel adhered to an inner surface and an outer surface of the cover member, thereby covering and wrapping around the first edge of the cover member; and at least one inner panel attached to the second edge of the cover member, and configured to interface with an inner side surface of the headphone.

19. The protective headphone cover of claim 18, wherein the elastic strip panel comprises a single-sided adhesive tape layer operable to be activated and adhered to the cover member in response to the application of at least one of heat or pressure.

20. The protective headphone cover of claim 18, wherein the elastic strip panel comprises a first elastic edge and an opposing second elastic edge, and a middle elastic portion situated between the first and second elastic edges, wherein the middle elastic portion covers the first edge of the protective headphone cover.

21. The protective headphone cover of claim 20, wherein the first elastic edge extends continuously about the inner surface of the cover member, and wherein the second elastic edge extends continuously about the outer surface of the cover member.

22. The protective headphone cover of claim 18, further comprising an edge joining member securing together third and fourth edges of the cover member, the edge joining member comprising an adhesive layer.

23. A method of making a protective headphone cover, comprising:

forming a cover member adapted to interface with an outer side surface of a headphone, the cover member comprising a first edge and an opposing second edge;

adhering an elastic locking member to the first edge of the cover member and supported about an expanding opening in the cover member, the elastic locking member being adapted to wrap around the outer side surface of the headphone and to secure the protective headphone cover in place about the headphone;

forming at least one inner panel having a perimeter edge attached to the second edge of the cover member; and attaching the perimeter edge of the at least one inner panel to the second edge of the cover member so as to interface with an inner side surface of the headphone.

24. The method of claim 23, wherein the elastic locking member comprises single-sided adhesive tape layer, and wherein attaching the elastic locking member to the first edge of the cover member comprises folding the elastic locking member over the first edge, and then applying at least one of heat or pressure to the elastic locking member and the cover member to activate the adhesive and adhere the elastic locking member to the cover member.

25. The method of claim 24, further comprising overlapping ends of the elastic locking member prior to activating the adhesive layer, such that the overlapped ends are adhered together.

* * * * *